US010106873B2

(12) United States Patent
Sakurada et al.

(10) Patent No.: US 10,106,873 B2
(45) Date of Patent: Oct. 23, 2018

(54) HOT-ROLLED STEEL SHEET AND MANUFACTURING METHOD FOR SAME

(71) Applicant: NIPPON STEEL & SUMITOMO METAL CORPORATION, Tokyo (JP)

(72) Inventors: Eisaku Sakurada, Tokyo (JP); Kunio Hayashi, Tokyo (JP); Koichi Sato, Tokyo (JP); Shunji Hiwatashi, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 550 days.

(21) Appl. No.: 14/371,276

(22) PCT Filed: Jan. 8, 2013

(86) PCT No.: PCT/JP2013/050134
§ 371 (c)(1),
(2) Date: Jul. 9, 2014

(87) PCT Pub. No.: WO2013/105555
PCT Pub. Date: Jul. 18, 2013

(65) Prior Publication Data

US 2015/0023834 A1 Jan. 22, 2015

(30) Foreign Application Priority Data

Jan. 13, 2012 (JP) ..... 2012-004554

(51) Int. Cl.
*C22C 38/14* (2006.01)
*C22C 38/28* (2006.01)
(Continued)

(52) U.S. Cl.
CPC ..... *C22C 38/28* (2013.01); *B21B 3/02* (2013.01); *B21B 45/004* (2013.01);
(Continued)

(58) Field of Classification Search
CPC ..... C22C 38/14; C22C 38/28; C22C 38/12
See application file for complete search history.

(56) References Cited

U.S. PATENT DOCUMENTS 9,752,217 B2 * 9/2017 Yokoi ..... C21D 8/0226
2010/0084054 A1 * 4/2010 Yokoi ..... C21D 8/021 148/504
2010/0196189 A1 * 8/2010 Nakagawa ..... C21D 8/0426 420/114

FOREIGN PATENT DOCUMENTS

CA 2831551 A1 * 10/2012 ..... C21D 8/0226
CN 1989267 A 6/2007
(Continued)

OTHER PUBLICATIONS

Taiwanese Office Action dated May 29, 2015, issued in corresponding Taiwanese Patent Application No. 102101127.
(Continued)

*Primary Examiner* — Colleen P Dunn
*Assistant Examiner* — Jeremy C Jones
(74) *Attorney, Agent, or Firm* — Birch, Stewart, Kolasch & Birch, LLP

(57) ABSTRACT

A hot-rolled steel sheet including, in terms of % by mass, 0.030% to 0.120% of C, 1.20% or less of Si, 1.00% to 3.00% of Mn, 0.01% to 0.70% of Al, 0.05% to 0.20% of Ti, 0.01% to 0.10% of Nb, 0.020% or less of P, 0.010% or less of S, and 0.005% or less of N, and a balance consisting of Fe and impurities, in which 0.106≥(C %-Ti %*12/48-Nb %*12/93) ≥0.012 is satisfied; a pole density of {112}(110) at a position of ¼ plate thickness is 5.7 or less; an aspect ratio (long axis/short axis) of prior austenite grains is 5.3 or less; a density of (Ti, Nb)C precipitates having a size of 20 nm or less is $10^9$ pieces/$mm^3$ or more; a yield ratio YR, which is the
(Continued)

FORMULA (1) Excessive C = C% − Ti% × 12/48 − Nb% × 12/93 ratio of a tensile strength to a yield stress, is 0.80 or more; and a tensile strength is 590 MPa or more.

4 Claims, 14 Drawing Sheets

(51) Int. Cl.

| | |
|---|---|
| ***C22C 38/04*** | (2006.01) |
| ***C21D 9/46*** | (2006.01) |
| ***C22C 38/00*** | (2006.01) |
| ***C22C 38/02*** | (2006.01) |
| ***C22C 38/06*** | (2006.01) |
| ***C22C 38/12*** | (2006.01) |
| ***C21D 8/02*** | (2006.01) |
| ***B21B 3/02*** | (2006.01) |
| ***B21B 45/00*** | (2006.01) |
| ***B21B 45/02*** | (2006.01) |
| ***C22C 38/24*** | (2006.01) |
| ***C22C 38/26*** | (2006.01) |
| ***C21D 6/00*** | (2006.01) |

(52) U.S. Cl.

CPC ..... *B21B 45/0203* (2013.01); *C21D 6/005* (2013.01); *C21D 8/0205* (2013.01); *C21D 8/0226* (2013.01); *C21D 9/46* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/24* (2013.01); *C22C 38/26* (2013.01); *C21D 2211/004* (2013.01)

(56) References Cited

FOREIGN PATENT DOCUMENTS

| | | | | |
|---|---|---|---|---|
| EP | 1288322 | A1 | | 3/2003 |
| EP | 1431407 | A1 | | 6/2004 |
| EP | 1806421 | A1 | | 7/2007 |
| JP | 2002-161340 | A | | 6/2002 |
| JP | 2004-027249 | A | | 1/2004 |
| JP | 2005-002406 | A | | 1/2005 |
| JP | 2005-314796 | A | | 11/2005 |
| JP | 2006-161112 | A | | 6/2006 |
| JP | 2009-007660 | A | | 1/2009 |
| JP | 2009-263715 | A | | 11/2009 |
| JP | 2009263715 | A | * | 11/2009 |
| JP | 2012-001775 | A | | 1/2012 |
| WO | WO 2010/131303 | A1 | | 11/2010 |

OTHER PUBLICATIONS

European Office Action dated Oct. 6, 2016, for European Application No. 13736012.9.

International Search Report issued in PCT/JP2013/050134, dated May 14, 2013.

Kunishige et al., "Strength, Low Temperature Toughness and Formability of Thermo-mechanically Treated Ti-bearing Steel Sheet", The Iron and Steel Institute of Japan, Tetsu-to-Hagané, 1985, vol. 71, No. 9, pp. 1140-1146.

Written Opinion issued in PCT/JP2013/050134, dated May 14, 2013.

* cited by examiner

FORMULA (1) Excessive C = C% − Ti% × 12/48 − Nb% × 12/93

SAMPLE STEEL SHEET A : 0.06%C-0.01%Si-2.5%Mn-0.15%Ti-0.01%Nb-15ppmB

SAMPLE STEEL SHEET B : 0.06%C-0.01%Si-2.5%Mn-0.15%Ti-0.01%Nb-15ppmB

SAMPLE STEEL SHEET C : 0.06%C-0.01%Si-2.5%Mn-0.15%Ti-0.01%Nb-15ppmB

HOT-ROLLED STEEL SHEET AND MANUFACTURING METHOD FOR SAME

TECHNICAL FIELD

This invention relates to a precipitation-strengthened hot-rolled steel sheet having excellent formability and excellent fatigue properties of a sheared edge, and a method of manufacturing the steel sheet.

This application claims priority from Japanese Patent Application No. 2012-004554, the disclosure of which is incorporated herein by reference.

BACKGROUND ART

In recent years, an attempt to reduce the weight of automobiles or various machine parts has been made. The reduction in weight can be realized by the optimization design of the part's shape to ensure rigidity. In the case of hollow parts such as press-formed parts, the reduction in weight can be directly realized by reducing the plate thickness. However, in order to maintain the static fracture strength and the yield strength while reducing the plate thickness, it is necessary to use a high-strength material for the parts. For this purpose, an attempt to apply a steel sheet having a tensile strength of 590 MPa or more to a low-cost steel material having excellent strength properties has been made. Meanwhile, in order to highly strengthen the material, it is necessary to satisfy both of high strength and formability such as fracture limit during shape forming or burring formability. Furthermore, when the parts are applied to chassis parts, a steel sheet based on precipitation-strengthening by the addition of micro-alloy elements has been developed in order to ensure toughness of an arc-welded part and to suppress HAZ softening. In addition to this, various steel sheets have been developed (for example, see Patent Documents 1 to 5).

The above-described micro-alloy elements promote the precipitation of coherent precipitates of approximately several nanometers to several tens of nanometers in size at a temperature below the Ac1 temperature. In the process of manufacturing the hot-rolled steel sheet, the strength of the steel sheet can be significantly improved by such coherent precipitates, but there is a problem in that fine cracks are generated at a sheared edge and formability is deteriorated, as disclosed in Non-patent Document 1 for example. Furthermore, the deterioration in a sheared edge significantly deteriorates fatigue properties of the sheared edge. In Non-patent Document 1, this problem was solved by utilizing microstructure strengthening while using alloy constituents to which micro-alloy elements were added. However, when the microstructure strengthening is utilized, it is difficult to achieve a high yield strength required for the parts, and the suppression of the deterioration of the sheared edge of the precipitation-strengthened hot-rolled steel sheet remains an issue.

Patent Document 1: Japanese Patent Application Laid-Open (JP-A) No. 2002-161340
Patent Document 2: JP-A No. 2004-27249
Patent Document 3: JP-A No. 2005-314796
Patent Document 4: JP-A No. 2006-161112
Patent Document 5: JP-A No. 2012-1775
Non-patent Document 1: Kunishige et al., TETSU-TO-HAGANE, vol. 71, No. 9, pp. 1140-1146 (1985)

SUMMARY OF INVENTION

Technical Problem

The invention can solve the above-described problem relating to the deterioration of formability and fatigue properties of a sheared edge in a precipitation-strengthened hot-rolled steel sheet. The invention provides a hot-rolled steel sheet having excellent formability and fatigue properties of a sheared edge with a tensile strength of 590 MPa or more, and a method of manufacturing the steel sheet.

Solution to Problem

The inventors achieved the suppression of the deterioration of a sheared edge in the above-described steel sheet containing precipitated elements by adjusting the individual contents of micro-alloy elements and carbon to their respective appropriate ranges and controlling a crystal orientation. The summary of the invention is as follows.

(1) A hot-rolled steel sheet including, in terms of % by mass, 0.030% to 0.120% of C, 1.20% or less of Si, 1.00% to 3.00% of Mn, 0.01% to 0.70% of Al, 0.05% to 0.20% of Ti, 0.01% to 0.10% of Nb, 0.020% or less of P, 0.010% or less of S, and 0.005% or less of N, and a balance consisting of Fe and impurities, in which $0.106 \geq (C\ \%\text{-}Ti\ \%*12/48\text{-}Nb\ \%*12/93) \geq 0.012$ is satisfied; a pole density of {112}(110) at a position of ¼ plate thickness is 5.7 or less; an aspect ratio (long axis/short axis) of prior austenite grains is 5.3 or less; a density of (Ti, Nb)C precipitates having a size of 20 nm or less is $10^9$ pieces/$mm^3$ or more; a yield ratio YR, which is the ratio of a tensile strength to a yield stress, is 0.80 or more; and a tensile strength is 590 MPa or more.

(2) The hot-rolled steel sheet according to (1), further including, in terms of % by mass, one or more of 0.0005% to 0.0015% of B, 0.09% or less of Cr, 0.01% to 0.10% of V, or 0.01% to 0.2% of Mo, in which $0.106 \geq (C\ \%\text{-}Ti\ \%*12/48\text{-}Nb\ \%*12/93\text{-}V\ \%*12/51) \geq 0.012$ is satisfied in a case where the hot-rolled steel sheet contains V.

(3) A method of manufacturing a hot-rolled steel sheet, the method including:

heating a steel to 1250° C. or higher, the steel including, in terms of % by mass, 0.030% to 0.120% of C, 1.20% or less of Si, 1.00% to 3.00% of Mn, 0.01% to 0.70% of Al, 0.05% to 0.20% of Ti, 0.01% to 0.10% of Nb, 0.020% or less of P, 0.010% or less of S, and 0.005% or less of N, and a balance consisting of Fe and impurities, in which $0.106 \geq (C\ \%\text{-}Ti\ \%*12/48\text{-}Nb\ \%*12/93) \geq 0.012$ is satisfied;

hot rolling the heated steel at a final rolling temperature of 960° C. or higher in finish rolling with a total of rolling reductions at two stands from a last stand of 30% or more when a Ti content is in a range of $0.05\% \leq Ti \leq 0.10\%$, or at a final rolling temperature of 980° C. or higher in finish rolling with a total of rolling reductions at two stands from a last stand of 40% or more when a Ti content is in a range of $0.10\% < Ti \leq 0.20\%$; and coiling the hot rolled steel at 450° C. to 650° C.

(4) The method of manufacturing a hot-rolled steel sheet according to (3), in which the steel further includes, in terms of % by mass, one or more of 0.0005% to 0.0015% of B, 0.09% or less of Cr, 0.01% to 0.10% of V, or 0.01% to 0.2% of Mo, in which 0.106≥(C %-Ti %*12/48-Nb %*12/93-V %*12/51)≥0.012 is satisfied in a case where the steel contains V.

Advantageous Effects of Invention

According to the invention, a hot-rolled steel sheet having excellent formability and fatigue properties of a sheared edge in which generation of fine cracks is suppressed at a sheared edge of a precipitation-strengthened hot-rolled steel sheet having a tensile strength of 590 MPa or more can be provided.

DESCRIPTION OF EMBODIMENTS

Figure 1:
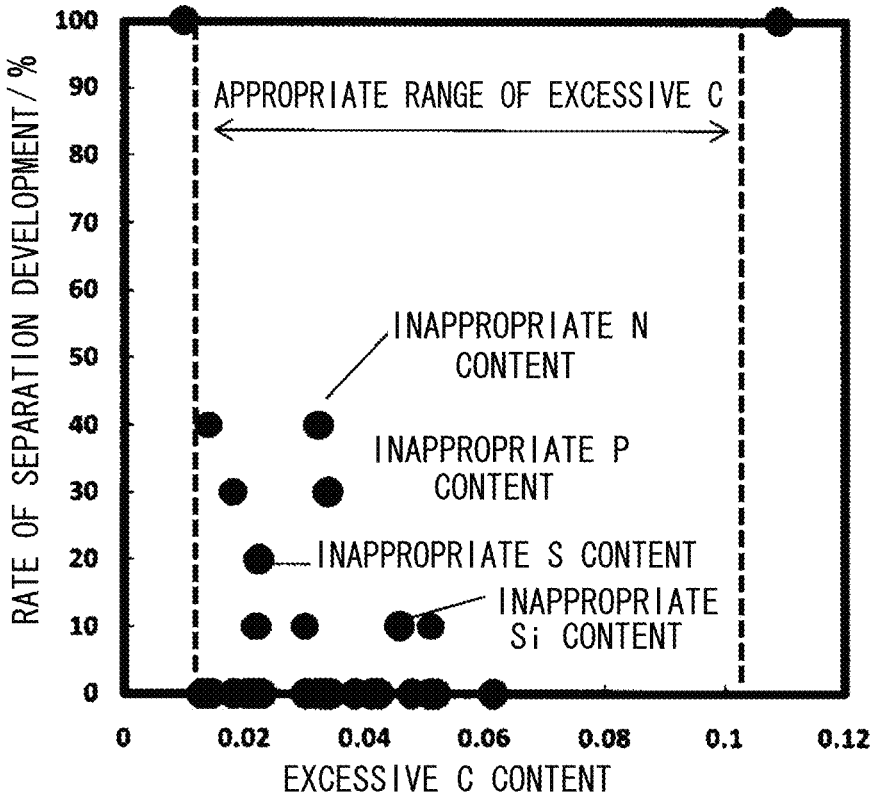
FIG. 1 shows an examination result of a relationship between an excessive C content and a rate of separation development.

Hereinbelow, the details of the invention are described.

Conventionally, there has been a problem in that fine cracks are generated at a sheared edge and formability and fatigue properties are deteriorated when precipitation strengthening by micro-alloy elements is utilized. In order to solve this problem, it is necessary to strengthen the steel sheet by utilizing microstructural strengthening using martensite or lower bainite. The inventors explored appropriate values with respect to the individual contents of micro-alloy elements and carbon in a precipitation-strengthened steel sheet, and found that the deterioration of the sheared edge of the precipitation-strengthened steel, which has been conventionally difficult to suppress, can be suppressed by controlling the microstructural morphology of the metal and the crystal orientation thereof, thereby successfully developing a hot-rolled steel sheet.

Hereinbelow, the reasons for limiting the ingredients of the hot-rolled steel sheet, which is a feature of the invention, are explained.

When the content of C is less than 0.030%, the desired strength cannot be obtained. Furthermore, the deficiency of C content relative to the lower limits of Ti and Nb contents for obtaining the desired strength causes a shortage of C precipitated at a grain boundary. As a result, the strength of the crystal grain boundary is decreased and roughness of the sheared edge is significantly increased, whereby separation is developed at the sheared edge.

When the content of C exceeds 0.120%, a density of cementite is increased. As a result, elongation properties and burring formability are deteriorated and separation is developed at the sheared edge due to the formation of a pearlite microstructure. Therefore, the content of C is set to from 0.030% to 0.120%.

Si is an effective element for suppressing coarsening of cementite and providing solid-solution strengthening. However, when the content of Si exceeds 1.20%, separation is developed at the sheared edge. Therefore, the content of Si is set to 0.120% or less. Since Si provides solid-solution strengthening and is effective as a deoxidizing agent, it is preferable to contain 0.01% or more of Si.

The content of Mn is set to from 1.00% to 3.00%. Since Mn is an element for providing solid-solution strengthening, it is essential to contain 1.00% or more of Mn in order to achieve a strength of 590 MPa or more. When the content of Mn exceeds 3.00%, Ti sulfide is formed in a Mn segregation portion, whereby elongation properties are significantly deteriorated. Therefore, the content of Mn is set to 3.00% or less.

Al is added as a deoxidizing element and is an effective element for reducing oxide in a steel and improving elongation properties by accelerating the transformation of ferrite. Therefore, the content of Al is set to 0.01% or more. When the content of Al exceeds 0.70%, a tensile strength of 590 MPa or more cannot be achieved, and further, a yield ratio YR of 0.80 or more cannot be achieved. Therefore, the content of Al is set to from 0.01% to 0.70%.

Ti provides precipitation strengthening by the formation of a carbide. It is necessary to contain more than 0.05% of Ti in order to achieve a steel strength of 590 MPa or more. In particular, when precipitated at a temperature below the Ac1 temperature, fine precipitation strengthening due to coherent precipitation can be provided. However, when the C content is low, the content of solute C is decreased, whereby the strength of the crystal grain boundary is decreased and roughness of the sheared edge is significantly increased, and separation is developed at the sheared edge.

In the invention, it was found that the deterioration of the sheared edge is suppressed and the separation is suppressed when the Ti content and the C content satisfy the following Formula (1), and the characteristics of the microstructural morphology of the metal described below are satisfied. Here, in the following Formula (1), "*" indicates "× (multiplication)".

$$0.106 \geq (C\ \%\text{-}Ti\ \%*12/48\text{-}Nb\ \%*12/93) \geq 0.012 \qquad \text{Formula (1):}$$

The relationship between the rate of separation development and the excessive C is shown in FIG. 1. The rate of separation development was 100% when the excessive C content was less than 0.012 or exceeded 0.106, which revealed an appropriate range of the excessive C. Samples having excessive C contents within the appropriate range exhibit rates of separation development of 50% or less, even when the content of another element is outside the range specified therefor. Therefore, it was confirmed that a separation suppression effect is obtained by satisfying the excessive C content specified by Formula (1). Meanwhile, the rate of separation development exceeded 0% even in some samples having contents of ingredients within their respective ranges specified by the invention. It was found that the separation development in such samples results from the microstructure of the metal. The details are described below.

Here, the excessive C means the excessive C content calculated according to "(C %-Ti %*12/48-Nb %*12/93)".

The rate of separation development is a value determined by cutting a blank having a size of 100 mm×100 mm×plate thickness out of a hot-rolled steel sheet, performing a punching test ten times using a cylindrical punch having a diameter of 10 mm with a clearance of 10%, and observing the punched surface. In a case in which separation is developed at the sheared edge, the fracture surface of the sheared edge exhibits a shelf-like texture with a step, and the maximum height measured with a roughness meter in the shear direction is 50 μm or more. Therefore, the separation development is defined by a step-like texture of the sheared edge and a maximum height of 50 μm or more. Here, the rate of separation development is a frequency of the separation development in the ten punching tests.

When the content of Ti exceeds 0.20%, it is difficult to form a solid solution of Ti completely even by a solution treatment. Furthermore, when the content of Ti exceeds 0.20%, the unsolidified Ti forms coarse carbonitride together with C and N in a slab. The coarse carbonitride remains in the produced plate, whereby toughness is significantly deteriorated and separation is developed at the sheared edge. Therefore, the content of Ti is set to from 0.05% to 0.20%. In order to ensure the toughness of a hot-rolled slab, the content of Ti is preferably set to 0.15% or less.

Nb can form a carbide of Nb alone and can also form a solid solution of (Ti, Nb)C in TiC, thereby reducing the size of carbide and exerting an extremely high precipitation strengthening ability. When the content of Nb is less than 0.01%, no precipitation strengthening effect can be obtained. On the other hand, when the content of Nb exceeds 0.10%, the precipitation strengthening effect is saturated. Therefore, the content of Nb is set to from 0.01% to 0.10%.

P is an element for solid-solution strengthening. When the content of P in the steel exceeds 0.020%, P segregates to the crystal grain boundary. As a result, the strength of the grain boundary is decreased, and separation is developed in the steel, and in addition to this, toughness is decreased, and the resistance to secondary working embrittlement is decreased. Therefore, the content of P is set to 0.020% or less. The lower limit of the P content is not particularly limited, and is preferably set to 0.001% in terms of cost of dephosphorization and productivity.

S deteriorates stretch flange-ability by the formation of a compound with Mn. Therefore, the content of S is preferably as low as possible. When the content of S exceeds 0.010%, the separation is developed at the sheared edge due to the band-like segregation of MnS. Therefore, the content of S is set to 0.010% or less. The lower limit of the S content is not particularly limited, and is preferably set to 0.001% in terms of cost and productivity.

N forms TiN before hot rolling. TiN has an NaCl-type crystal structure, and has a non-coherent interface with base iron. Therefore, cracks originating from TiN are generated during shearing, and separation at the sheared edge is accelerated. When the content of N exceeds 0.005%, it is difficult to suppress the separation at the sheared edge. Therefore, the content of N is set to 0.005% or less. The lower limit of the N content is not particularly limited, and is preferably 5 ppm % from the viewpoint of cost of denitrification and productivity.

Hereinbelow, optional elements are explained.

B can form a solid solution at the grain boundary and suppresses the segregation of P to the grain boundary, thereby improving the strength of the grain boundary and reducing the roughness of the sheared edge. A B content of 0.0005% or more is preferable, since a strength of 1080 MPa or more can be achieved and the separation at the sheared edge can be suppressed. Even when the content of B exceeds 0.0015%, no improvement effect associated with the inclusion is observed. Therefore, it is preferable that the content of B is set to from 0.0005% to 0.0015%.

Cr can form a solid solution in MC similar to V, and can provide strengthening through the formation of a carbide of Cr alone. When the content of Cr exceeds 0.09%, the effect is saturated. Therefore, the content of Cr is set to 0.09% or less. It is preferable that the content of Cr is set to 0.01% or more, in terms of securing the product strength.

V is replaced with TiC and precipitates in the form of (Ti, V)C, thereby realizing a high-strength steel sheet. When the content of V is less than 0.01%, no effect is produced. On the other hand, when the content of V exceeds 0.10%, surface cracking of a hot-rolled steel sheet is accelerated. Therefore, the content of V is set to from 0.01% to 0.10%. When the formula of $0.106 \geq (C\ \%\text{-}Ti\ \%*12/48\text{-}Nb\ \%*12/93\text{-}V\ \%*12/51) \geq 0.012$ is not satisfied, the content of solute C is decreased, whereby the strength of the crystal grain boundary is reduced and the roughness of the sheared edge is significantly increased, and thus, separation is developed at the sheared edge.

Mo is also an element for precipitation. When the content of Mo is less than 0.01%, no effect is produced. On the other hand, when the content of Mo exceeds 0.2%, elongation properties are deteriorated. Therefore, the content of Mo is set to from 0.01% to 0.2%.

Next, the characteristics of the invention, that is, the microstructure and the texture, are described.

When the steel sheet according to the invention satisfies the above-described ranges of the ingredients and the pole density of {112}(110) at a position of ¼ plate thickness is 5.7 or less, the separation at the sheared edge can be suppressed.

{112}(110) is a crystal orientation developed in a rolling process, and determined from an electron back-scattering pattern obtained using an electron beam accelerated by a voltage of 25 kV or more (electron back-scattering pattern by an EBSP method), and using a sample in which surface strains of the surface to be measured have been eliminated by electrochemical polishing of the rolling-direction section of the steel sheet using 5% perchloric acid. Here, the measurement is performed in a range of 1000 μm or more in the rolling direction and 500 μm in the plate thickness direction, and a measurement interval is preferably 3 μm to 5 μm. Other identification methods such as a method based on diffraction pattern by TME or X-ray diffraction are inadequate as the measurement method, since it is impossible to specify the measurement position by such methods.

With regard to the morphology of prior austenite grains, it was found that the separation at the sheared edge can be suppressed when the aspect ratio (long axis/short axis) thereof is 5.3 or less. Therefore, the aspect ratio is set to 5.3 or less.

Figure 2:
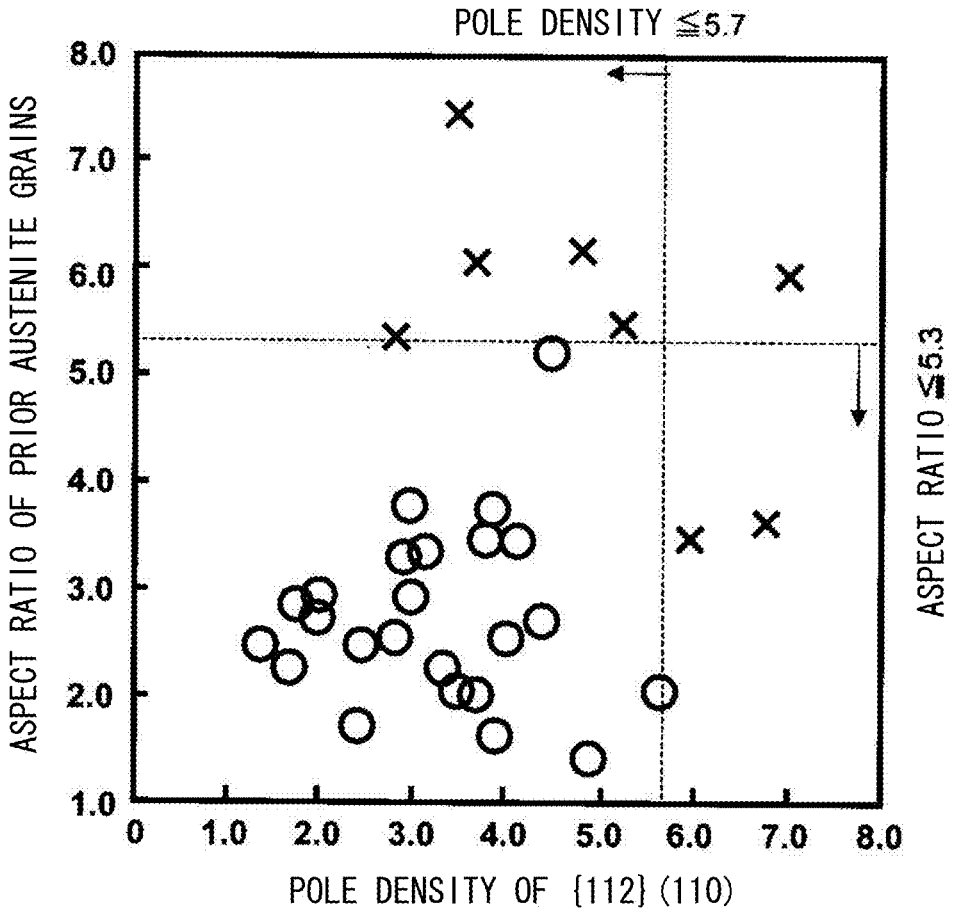
FIG. 2 shows an examination of the effect of an aspect ratio of prior austenite grains and a pole density of {112}(110) at a position of ¼ plate thickness on the separation development.

The relationship of the separation development to the aspect ratio and the pole density of {112}(110) is shown in FIG. 2. In this figure, a circle indicates that the rate of separation development is 0% in the evaluation of the separation, and a cross mark indicates that the rate of separation development exceeds 0%. Even when the contents of the ingredients fell within their respective appropriate ranges, an aspect ratio exceeding 5.3 resulted in separation development at any pole densities. On the other hand, none of the samples having contents of the ingredients within their respective appropriate ranges, an aspect ratio of 5.3 or less, and a pole density of 5.7 or less exhibited separation development. Here, in a method to reveal the prior austenite grains, it is preferable to use dodecylbenzene sulfonate, picric acid, or oxalic acid.

Figure 3:
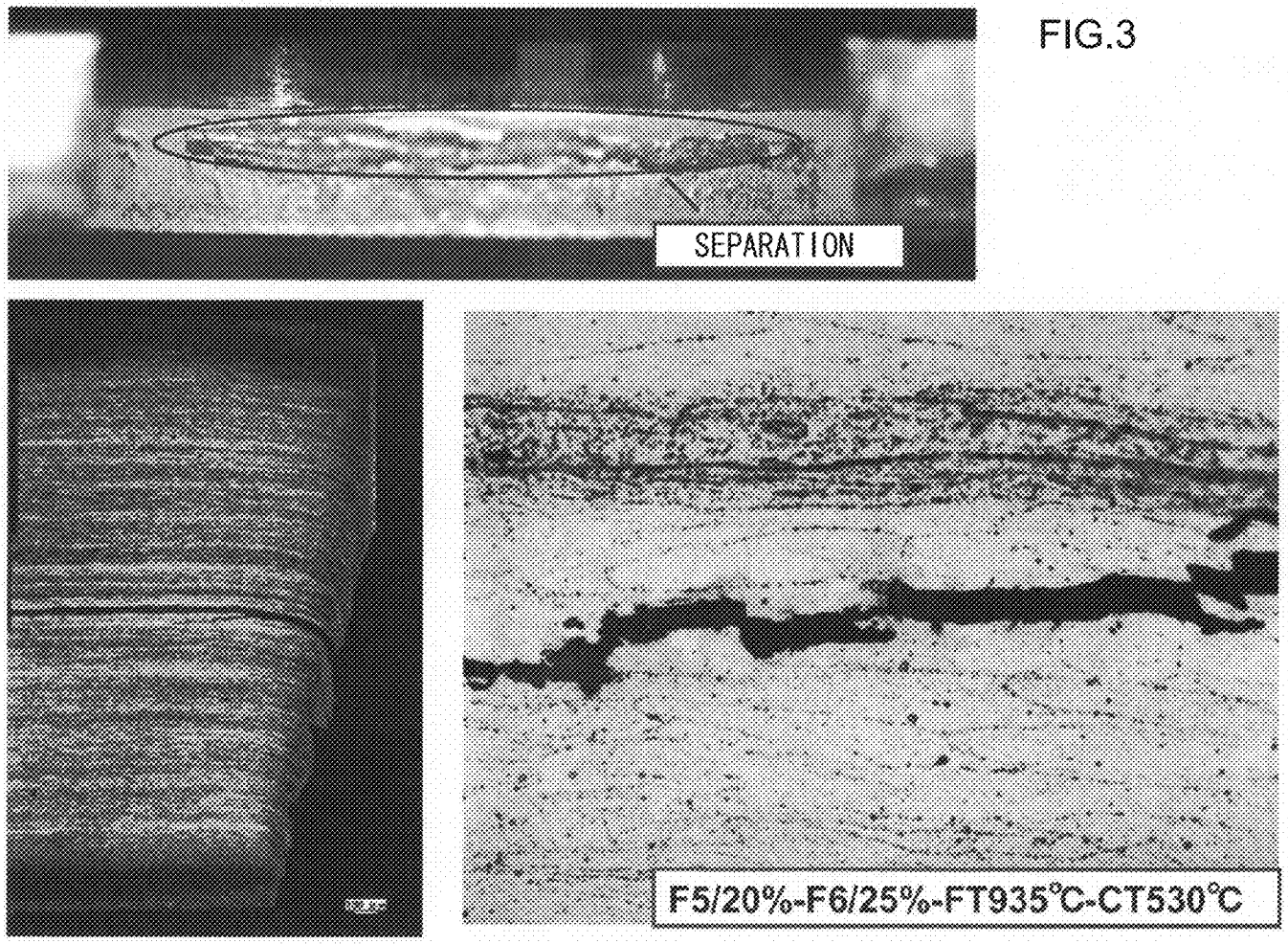
FIG. 3 shows an observation result of separation at a sheared edge of sample steel sheet A having an aspect ratio of prior austenite grains of more than 5.3.
Figure 4:
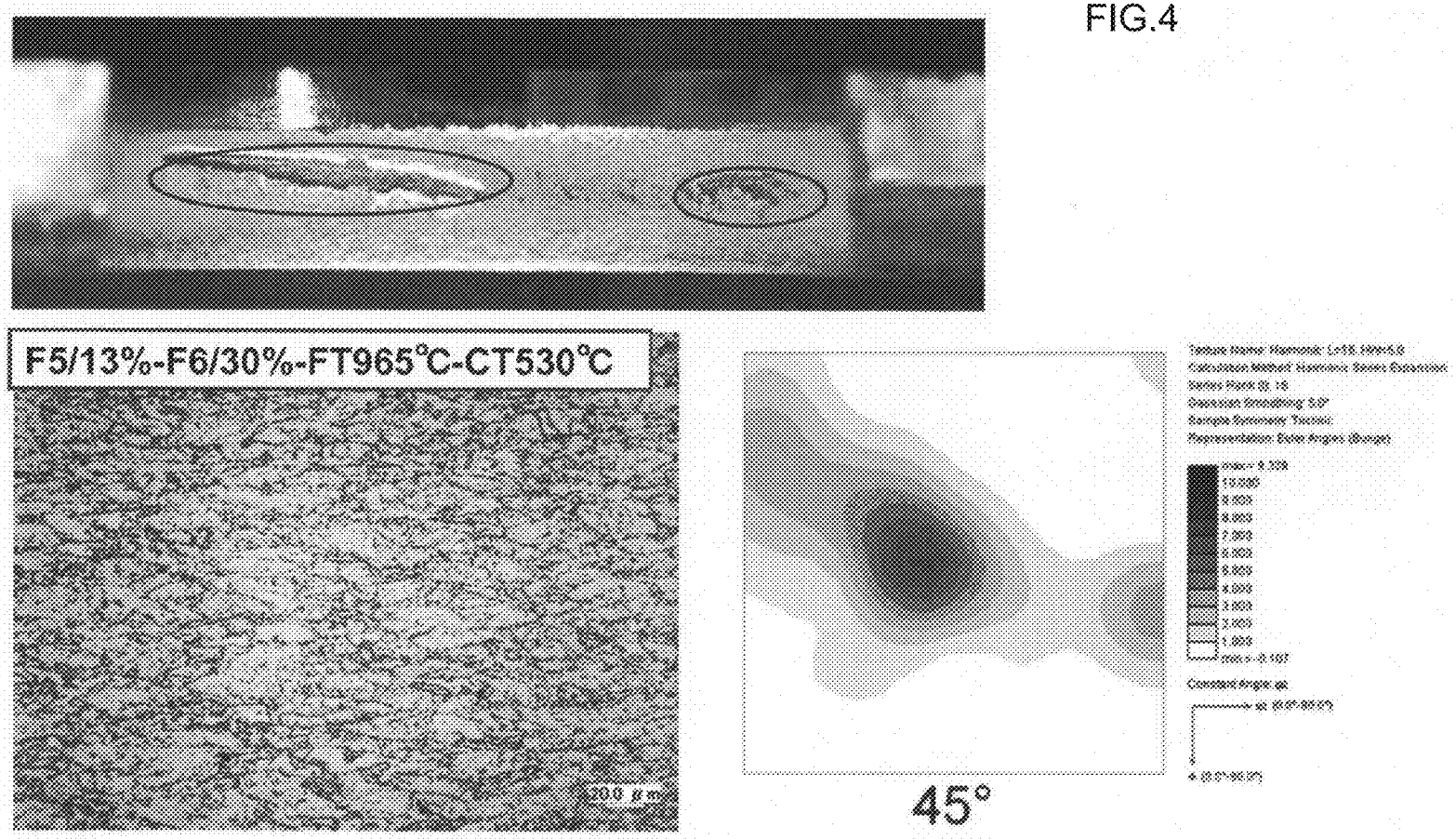
FIG. 4 shows an observation result of separation at a sheared edge of sample steel sheet B having an aspect ratio of prior austenite grains of 5.3 or less and a pole density of {112}(110) at a position of ¼ plate thickness of 5.7 or more.
Figure 5:
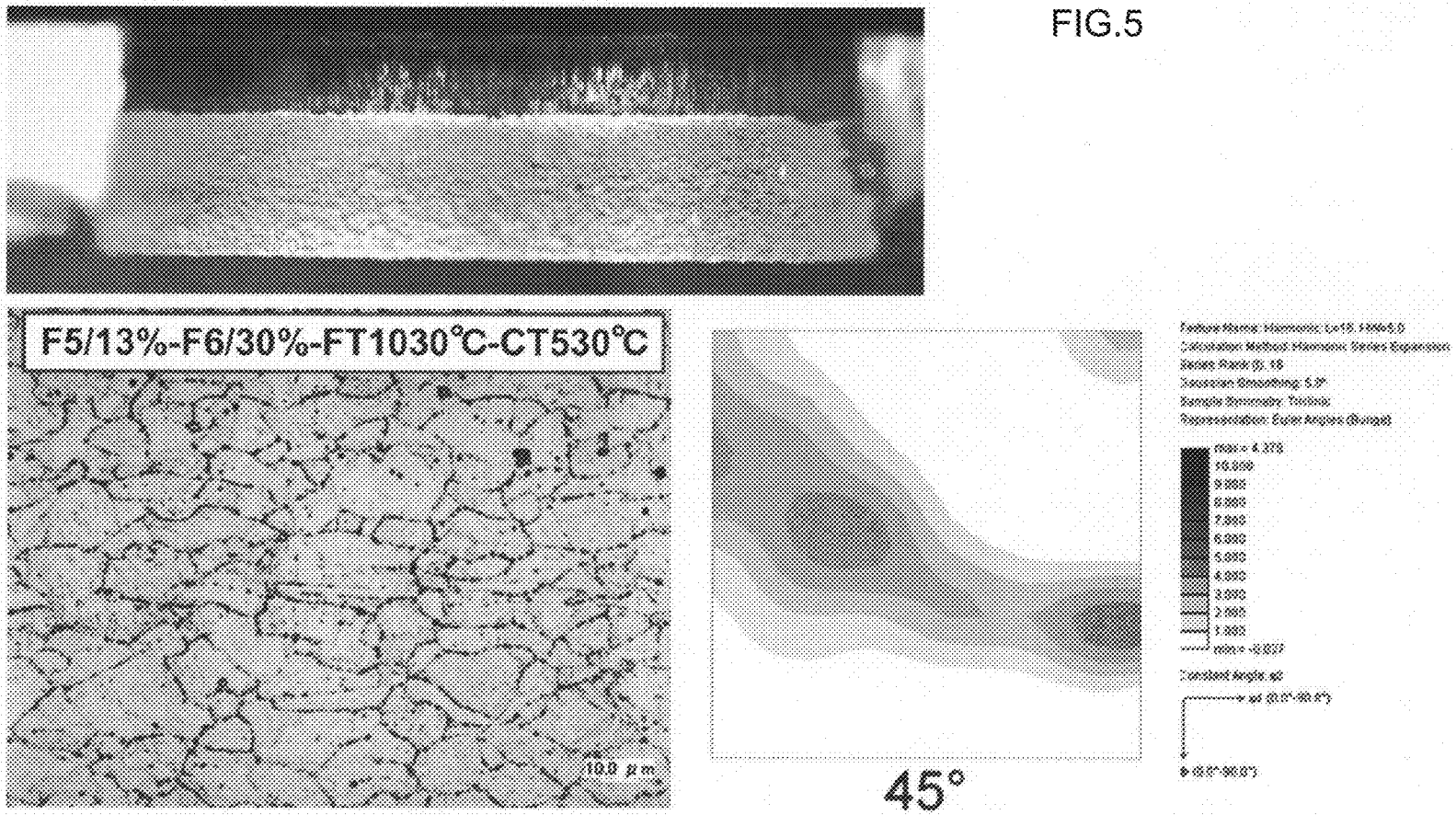
FIG. 5 shows an observation result of separation at a sheared edge of sample steel sheet C in which all of microstructural characteristics of a metal according to the invention—a balance of C, Ti, and Nb, a pole density of {112}(110) at a position of ¼ plate thickness, an aspect ratio of prior austenite grains, and a size and a density of (Ti, Nb)C precipitates—are satisfied.

The observation result of the separation at the sheared edge of sample steel sheet A having an aspect ratio of prior austenite grains of more than 5.3, using the above-described method to reveal the prior austenite grains is shown in FIG. 3. The separation at the sheared edge was exhibited as a shelf-like crack surface developed in a direction intersecting with the shear direction. As a result of the detailed observation, it was found that the crack extended along the grain boundary of the prior austenite. On the other hand, as shown in FIG. 4, in sample steel sheet B having an aspect ratio of prior austenite grains of 5.3 or less and a pole density of {112}(110) of 5.7 or more, the area of separation decreased according to the aspect ratio, but the separation was not completely suppressed. However, as shown in FIG. 5, in sample steel sheet C which satisfies all the characteristics of the microstructure of the metal according to the invention, that is, the balance of C, Ti, and Nb, the pole density of {112}(110) at a position of ¼ plate thickness, the aspect ratio of prior austenite grains, and the size and the density of (Ti, Nb)C precipitates, suppression of the separation was found, and no running of cracks at a specific crystal grain boundary was observed.

Figure 6:
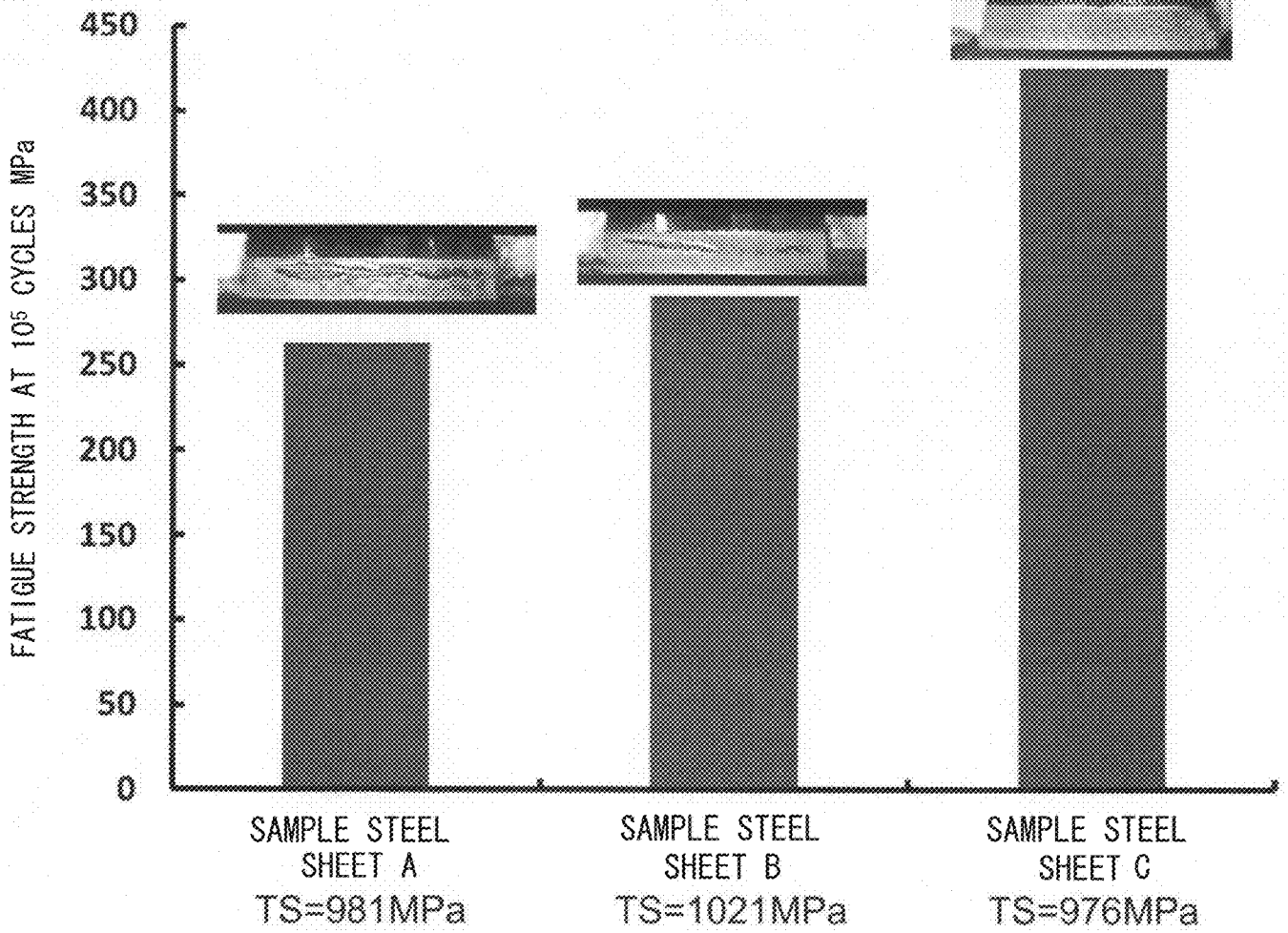
FIG. 6 is a graph showing results of punching fatigue tests for sample steel sheets A, B, and C.
Figure 7:
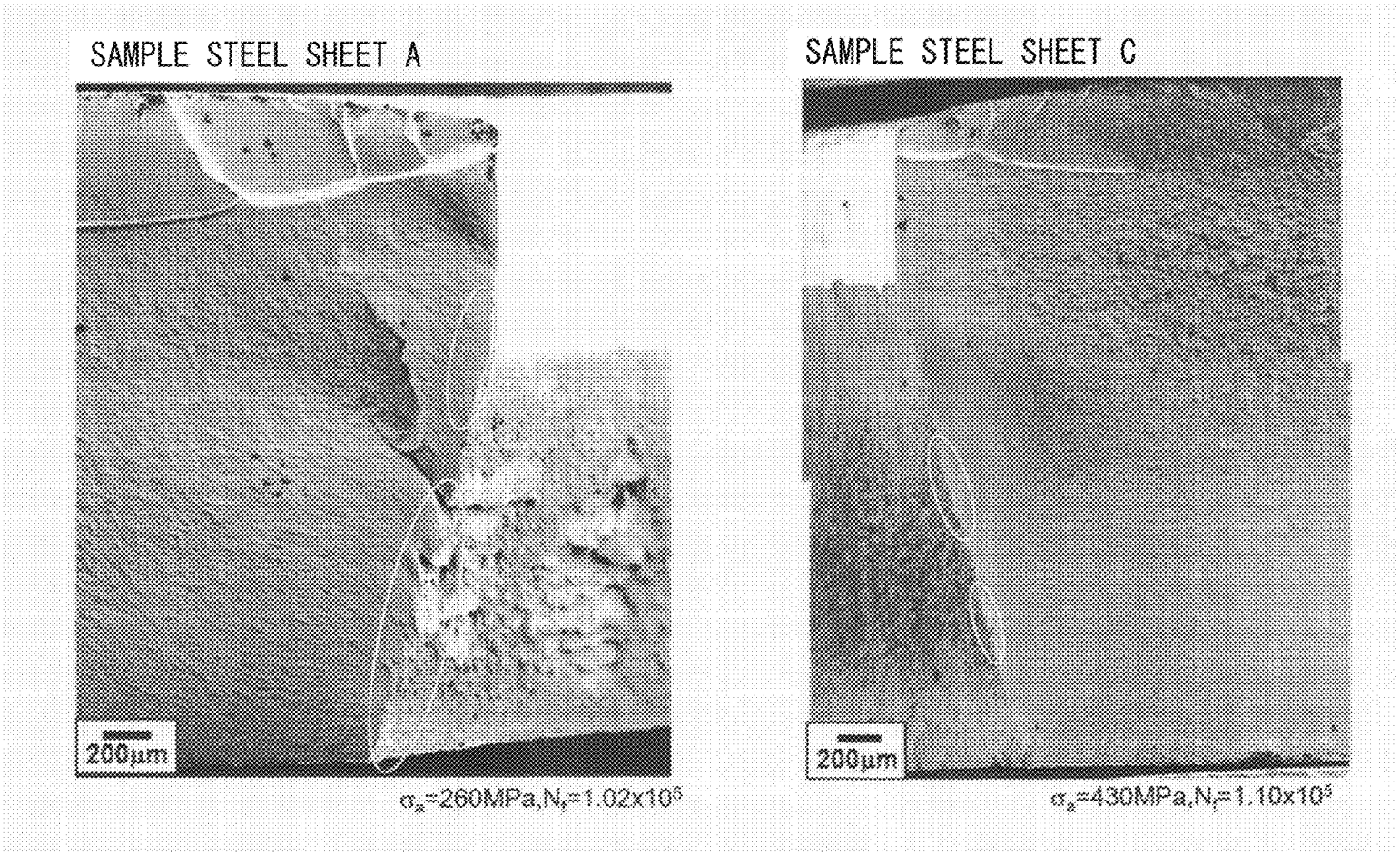
FIG. 7 is a comparison of fatigue fracture surfaces between sample steel sheet A and sample steel sheet C.

The results of the tests for punching fatigue of test steels A, B, and C are shown in FIG. 6. The tests for punching fatigue were performed with a Shank type fatigue tester, and the evaluation was carried out using a test piece which had been subjected to a punching shear processing of 10 mm-diameter with a side clearance of 10% at the center portion of the smooth test piece according to JISZ2275. Each of test steels A, B, and C has a tensile strength of about 980 MPa. In contrast to steel C in which the separation was suppressed, the fatigue strength at $10^5$ cycles in test steels A and B was decreased by about 50 MPa. The comparison of fatigue fracture surfaces between test steel A and test steel C is shown in FIG. 7. In test steel C, it was found that fatigue cracks were generated from the separated portion and that the decrease in the fatigue strength at finite life was caused by the separation development. In the shearing process, cracks initiated from the punch and die edges run in the sheet thickness direction along the strokes of the punch and combined together to form a sheared edge. It has been thought that, in a steel sheet strengthened by coherent precipitates based on Ti, the separation development cannot be suppressed because of a decrease in toughness. In the invention, the separation was observed in detail, the mechanism of the separation development was clarified, and it was found that the separation at the sheared edge can be suppressed and the fatigue strength of the sheared edge can be improved by appropriately adjusting the composition of the ingredients and controlling the microstructure of the metal to have appropriate crystal orientation and crystal grain morphology.

The density of (Ti, Nb)C precipitates having a size of 20 nm or less in the microstructure of the metal is required to be $10^9$ pieces/mm$^3$ more. This is because a yield ratio YR, of the tensile strength and the yield stress, of 0.80 or more cannot be achieved when the density of (Ti, Nb)C precipitates having a size of 20 nm or less is less than $10^9$ pieces/mm$^3$. On the other hand, the density of the precipitates is preferably $10^{12}$ pieces/mm$^3$ or less. It is preferable that the precipitates are measured by the observation of 5 or more fields by a transmission electron microscope at a high magnification of 10000-fold or more, using a replica sample prepared with a method described in JP-A 2004-317203. Here, the size of the precipitate refers to the equivalent circular diameter of the precipitate. A precipitate having a size of 1 nm to 20 nm is selected for the measurement of the precipitation density.

Figure 8:
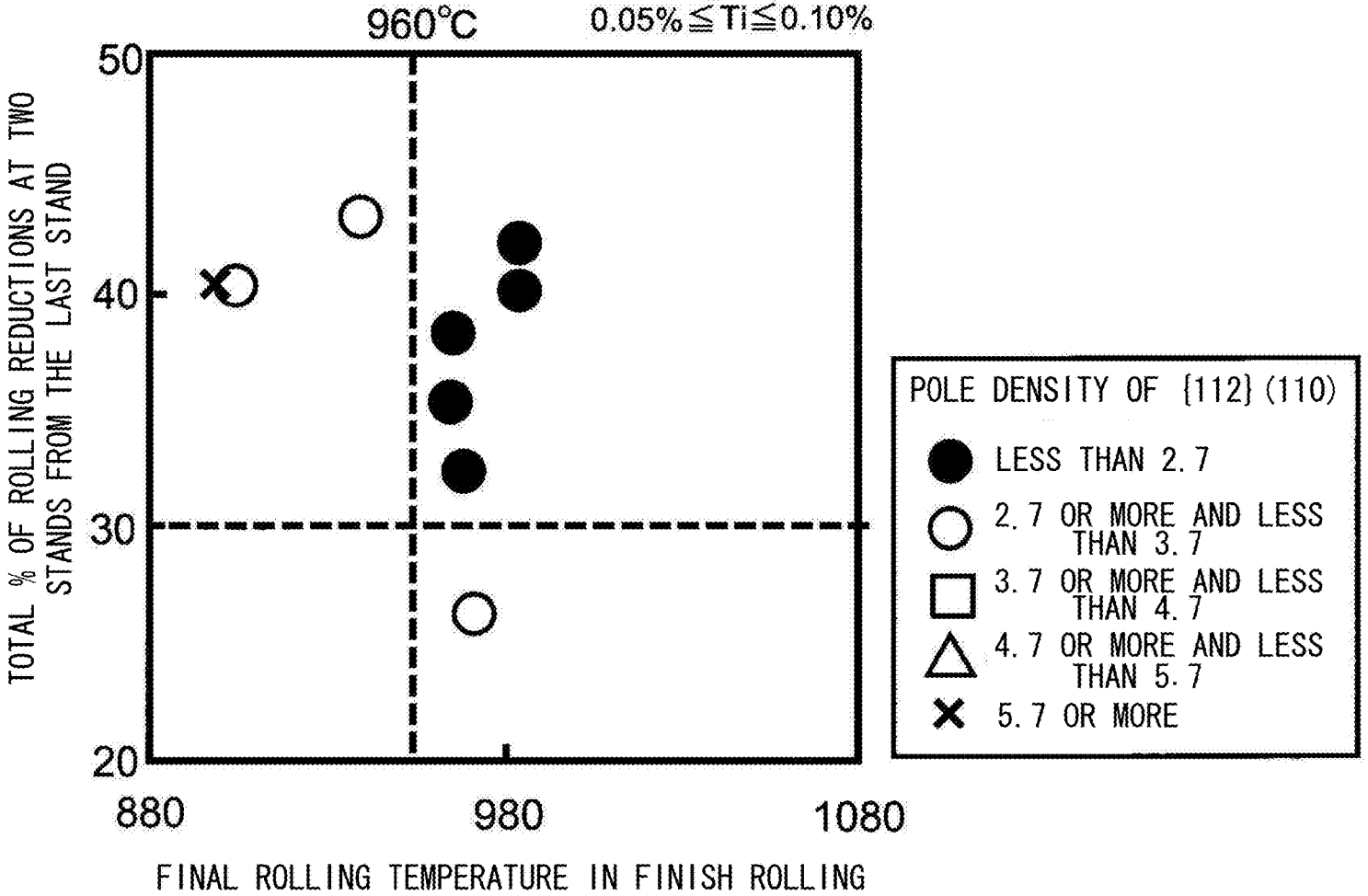
FIG. 8 shows an examination result of effects of a final rolling temperature and a total rolling reduction at the last two stands on a pole density of {112}(110) when the Ti content is 0.05% to 0.10%.
Figure 9:
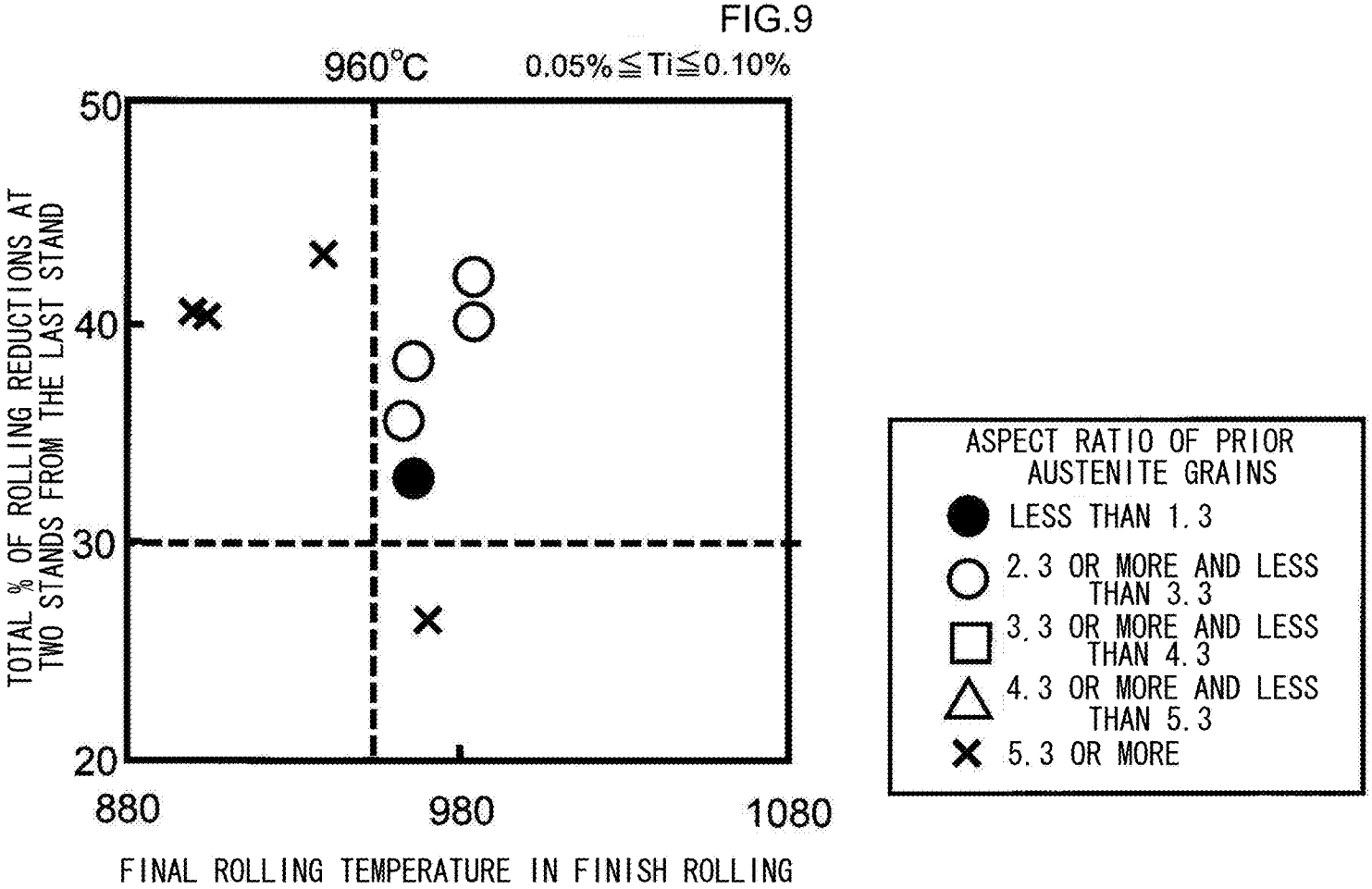
FIG. 9 shows an examination result of effects of a final rolling temperature and a total rolling reduction at the last two stands on an aspect ratio of prior austenite grains when the Ti content is 0.05% to 0.10%.
Figure 10:
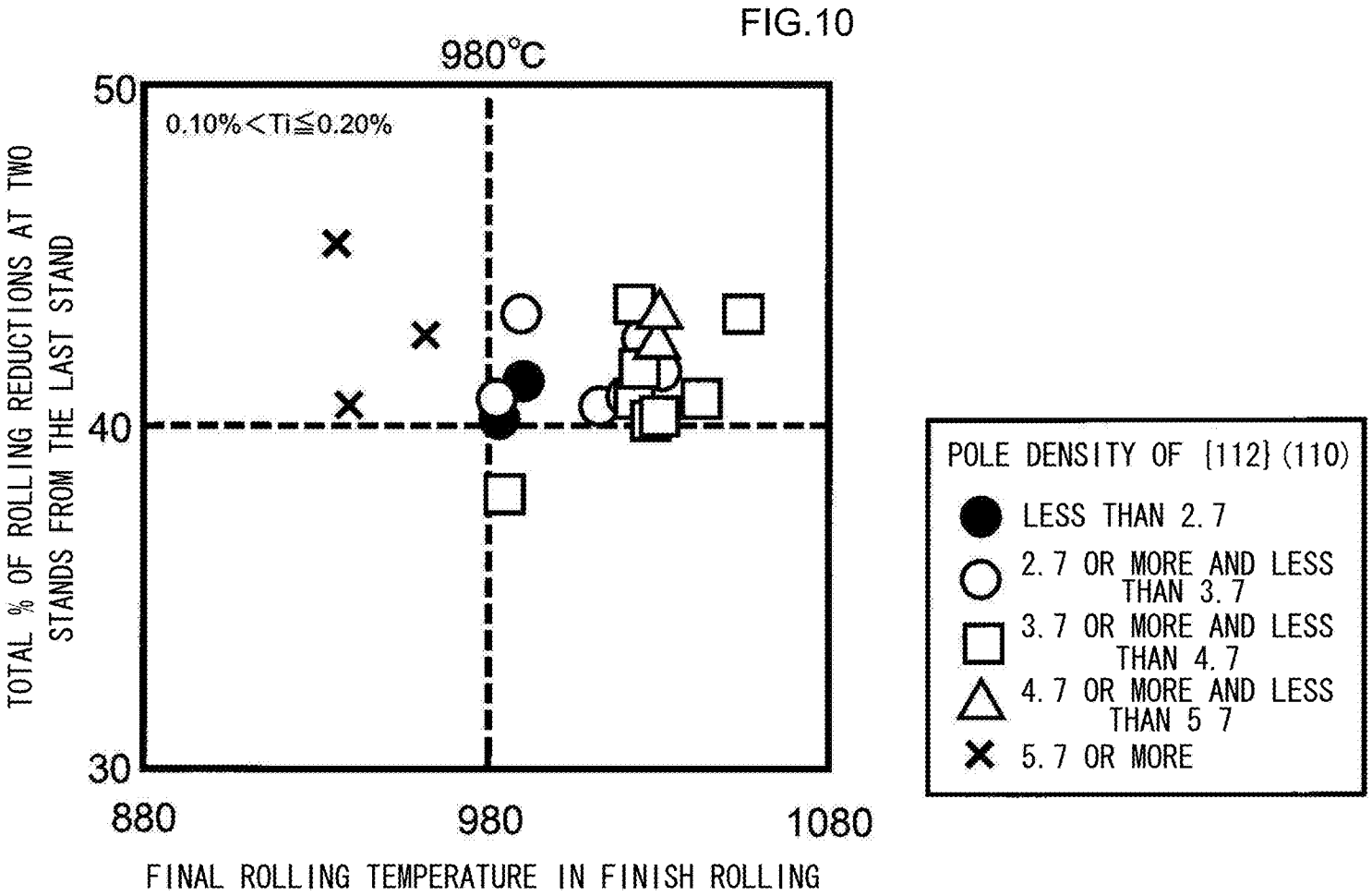
FIG. 10 shows an examination result of effects of a final rolling temperature and a total rolling reduction at the last two stands on a pole density of {112}(110) when the Ti content is more than 0.10% and 0.20% or less.
Figure 11:
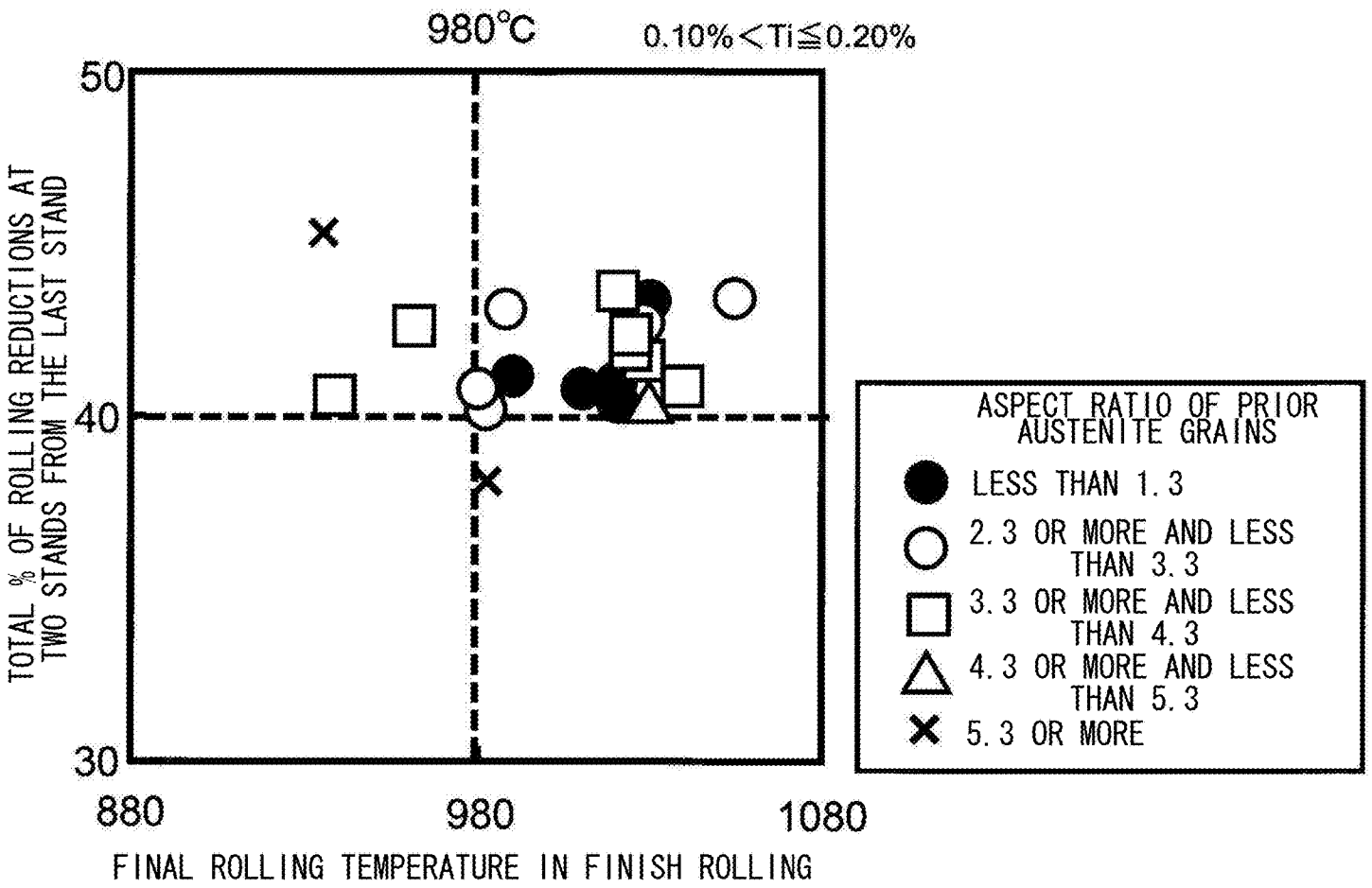
FIG. 11 shows an examination result of effects of a final rolling temperature and a total rolling reduction at the last two stands on an aspect ratio of prior austenite grains when the Ti content is more than 0.10% and 0.20% or less.

Hereinbelow, the characteristics of the method of manufacturing the steel sheet according to the invention are described. In the method of manufacturing the hot-rolled steel sheet according to the invention, the slab heating temperature is preferably 1250° C. or higher, in order to sufficiently solidify the precipitated elements contained. On the other hand, when the heating temperature exceeds 1300° C., coarsening of the austenite grain boundary is observed. Therefore, the heating temperature is preferably 1300° C. or less. In the invention, it was found that there is an appropriate range of the finish rolling condition that varies with the content of Ti. When the Ti content is in a range of $0.05\% \leq Ti \leq 0.10\%$, the final rolling temperature in finish rolling is required to be set to 960° C. or higher, and the total of the rolling reductions at two stands from the last stand is required to be set to 30% or more. When the Ti content is in a range of $0.10\% < Ti \leq 0.20\%$, the final rolling temperature in finish rolling is required to be set to 980° C. or higher, and the total of the rolling reductions at two stands from the last stand is required to be set to 40% or more. When any of these conditions fell outside the-above ranges, austenite recrystallization during rolling was not promoted, and the requirements of a pole density of {112}(110) at a position of ¼ plate thickness of 5.7 or less and an aspect ratio (long axis/short axis) of prior austenite grains of 5.3 or less were not met. The final rolling temperature in finish rolling (sometimes referred to as "finish rolling temperature") is a temperature measured with a thermometer placed within 15 m from the exit-side of the last stand of a finish rolling machine. The total of the rolling reductions at two stands from the last stand (the two stands from the last stand is sometimes referred to as "last two stands", and the total of the rolling reductions is sometimes referred to as "total rolling reduction") means the total value (simple sum) obtained by adding together the value of a rolling reduction at the last stand alone and the value of a rolling reduction at the second to last stand alone. The relationship between the final rolling conditions and the pole density of {112}(110) at a position of ¼ plate thickness and the relationship between the final rolling conditions and the aspect ratio of prior austenite grains in a Ti content range of 0.05%≤Ti≤0.10% are shown in FIGS. 8 and 9, respectively. It was found that, in a Ti content range of 0.05%≤Ti≤0.10%, the aspect ratio of prior austenite grains exceeded 5.3 when the finish rolling temperature or the total rolling reduction at two stands from the last stand fell outside the conditions according to the invention. The results of similar examinations in a Ti content range of 0.10%<Ti≤0.20% are shown in FIGS. 10 and 11. In a range of 0.10%<Ti≤0.20%, the pole density of {112}(110) at a position of ¼ plate thickness exceeded 5.7 in some samples even when the finish rolling temperature was 960° C. or higher; setting the finish rolling temperature to 980° C. or higher resulted in a pole density of {112}(110) at a position of ¼ plate thickness of 5.7 or less. Furthermore, when the finish rolling temperature was 980° C. or higher and the total of the rolling reductions at two stands from the last stand was 40% or more, both of the conditions of the pole density and the aspect ratio were satisfied. This is due to the effect of Ti to inhibit the recrystallization of austenite, and it is indicated that there is an optimum finish rolling condition for producing the effect, which varies with the content of Ti. These examinations revealed optimum finish rolling conditions for the ingredient range according to the invention. Here, it is preferable to set the finish rolling temperature to 1080° C. or less and the total of the rolling reductions at two stands from the last stand to 70% or less, both in a range of 0.05%≤Ti≤0.10% and in a range of 0.10%<Ti≤0.20%.

The coiling after the finish rolling is required to be performed at a temperature of 450° C. or higher. When the temperature is less than 450° C., it is difficult to produce a precipitation-strengthened hot-rolled steel sheet having homogenous microstructure, and achieve a yield ratio YR of 0.80 or more. It is often the case that the hot-rolled steel sheet is mainly applied to suspension parts, and therefore, it is necessary to increase the fracture stress of the parts as well as to reduce the permanent deformation of the parts. In the hot-rolled steel sheet according to the invention, the yield ratio YR is increased by the precipitation of (Ti, Nb)C. When the coiling is performed at a temperature exceeding 650° C., coarsening of the precipitate is accelerated, and the strength of the steel sheet in accordance with the content of Ti cannot be obtained. Furthermore, when the coiling temperature exceeds 650° C., the Orowan mechanism is less effective due to the coarsening of (Ti, Nb)C, thereby decreasing the yield stress, and a desired yield ratio YR of 0.80 or more cannot be achieved.

Figure 12:
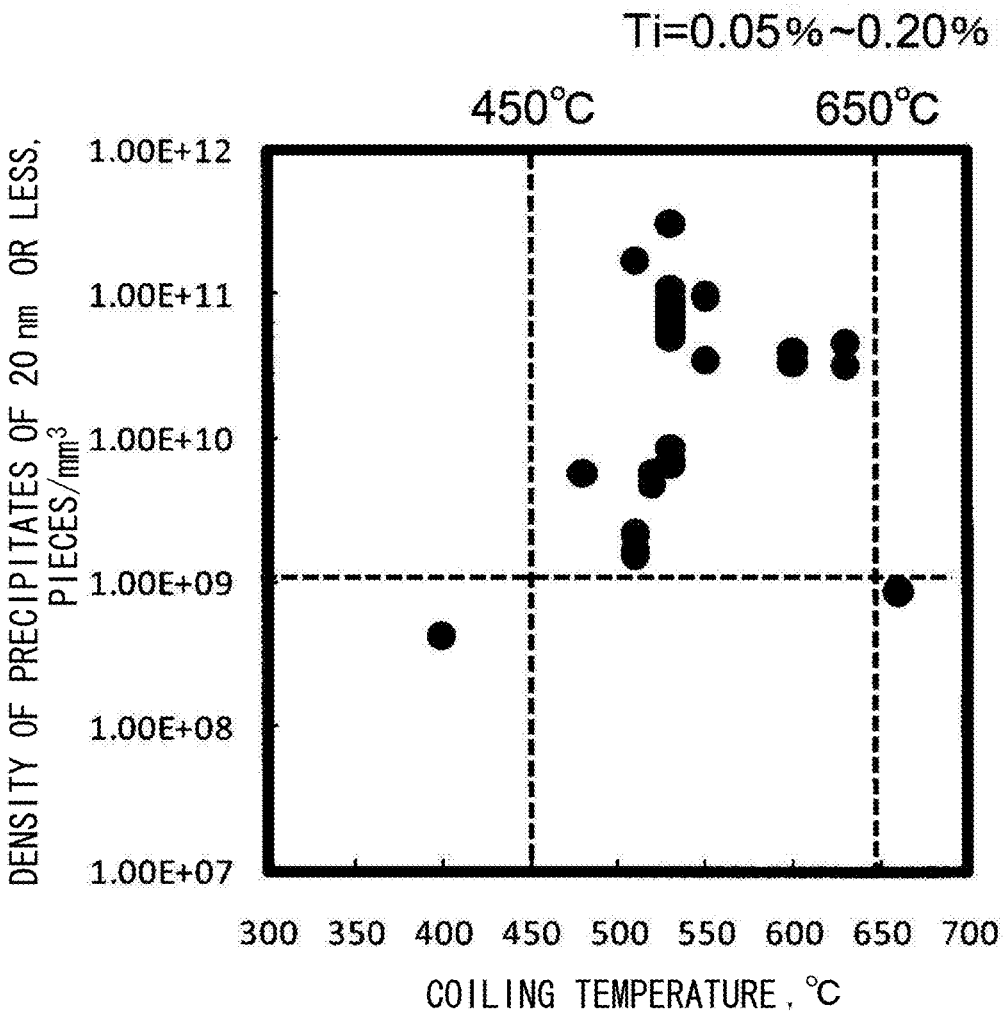
FIG. 12 shows an examination result of a relationship between a density of precipitates having a size of 20 nm or less and a coiling temperature.
Figure 13:
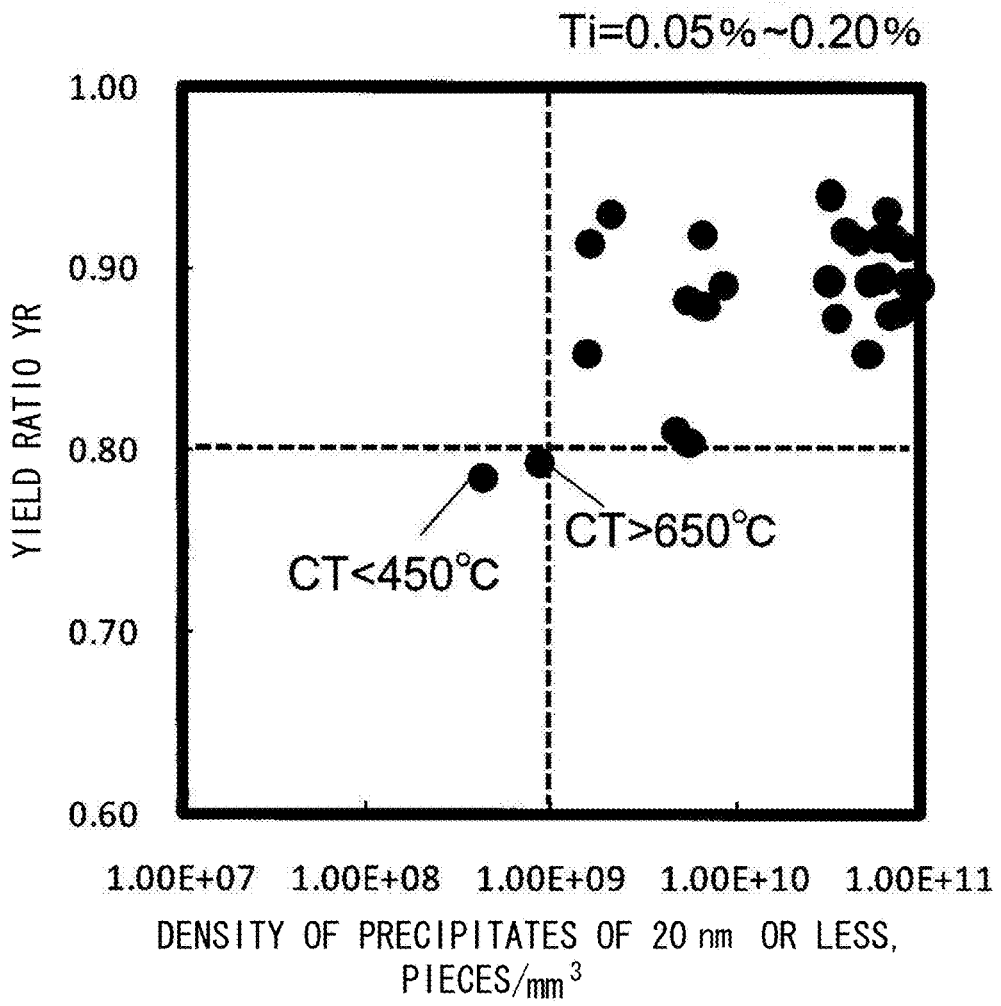
FIG. 13 shows an examination result of a relationship between a density of precipitates having a size of 20 nm or less and a yield ratio YR.

The relationship between the temperature of coiling of a hot-rolled steel sheet having a Ti content of 0.05% to 0.20% and the density of precipitates having a size of 20 nm or less is shown in FIG. 12. When the coiling temperature is less than 450° C. or exceeds 650° C., the density of precipitates was less than $10^9$ pieces/mm$^3$; as a result, the yield ratio YR of 0.80 or more cannot be achieved as shown in FIG. 13, and it is found that a hot-rolled steel sheet of high yield stress cannot be produced.

In the hot-rolled steel sheet according to the invention, the C content may be in a range of 0.36% to 0.100%, the Si content may be in a range of 0.01% to 1.19%, the Mn content may be in a range of 1.01% to 2.53%, the Al content may be in a range of 0.03% to 0.43%, the Ti content may be in a range of 0.05% to 0.17%, the Nb content may be in a range of 0.01% to 0.04%, the P content may be in a range of 0.008% or less, the S content may be in a range of 0.003% or less, the N content may be in a range of 0.003% or less, "C %-Ti %*12/48-Nb %*12/93" may be in a range of 0.061 to 0.014, the pole density may be in a range of 1.39 to 5.64, the aspect ratio of prior austenite grains may be in a range of 1.42 to 5.25, and the density of precipitates may be in a range of $1.55\times10^9$ pieces/mm$^3$ to $3.10\times10^{11}$ pieces/mm$^3$.

In the method of manufacturing a hot-rolled steel sheet according to the invention, the final rolling temperature in finish rolling may be in a range of 963° C. to 985° C. in a Ti content range of 0.05%≤Ti≤0.10%, the total of the rolling reductions at two stands from the last stand may be in a range of 32.5% to 43.2% in a Ti content range of 0.05%≤Ti≤0.10%, the final rolling temperature in finish rolling may be in a range of 981° C. to 1055° C. in a Ti content range of 0.10%<Ti≤0.20%, the total of the rolling reductions at two stands from the last stand may be in a range of 40.0% to 45.3% in a Ti content range of 0.10%<Ti≤0.20%, and the coiling temperature may be in a range of 480° C. to 630° C.

EXAMPLES

Hereinafter, examples of the invention are described.

A steel containing the chemical ingredients shown in Table 1 was produced by smelting, and a slab was obtained. The slab was heated to 1250° C. or higher, and subjected to six passes of finish rolling at a finish rolling temperature shown in Table 2. The resultant was cooled in a cooling zone at an average cooling rate of 5° C./s, and held for 1 hour at a temperature of 450° C. to 630° C. in a coiling reproducing furnace followed by air cooling, thereby producing a 2.9 mmt of steel sheet. The surface scale of the obtained steel sheet was removed using a 7% aqueous solution of hydrochloric acid, thereby producing a hot-rolled steel sheet. In the total rolling reduction indicated in Table 2, the total of the rolling reductions at the 5th and 6th passes is shown as the total rolling reduction at the last two stands from the last stand in the manufacturing step of the hot-rolled steel sheet The tensile strength TS and the elongation properties El of respective hot-rolled steel sheets were evaluated according to the test method described in JIS-Z2241 by manufacturing a No. 5 test piece as described in JIS-Z2201. The burring formability λ was evaluated according to the test method described in JIS-Z2256. The burring formability λ was evaluated according to the test method described in JIS-Z2256. With regard to the examination of the texture of the sheared edge, the presence or absence of shearing separation development was examined in the circumferential direction by visual inspection of a sample, which had been subjected to a punching shear processing using a cylindrical punch of 10 mm-diameter and a die with a clearance of 10%. The definition of the rate of the separation development and the measurement thereof are described above. In order to examine the fatigue properties of the sheared edge of the steel sheet, each of test steel sheets was processed into a flat test piece, and then processed into a test piece for evaluating the fatigue of the sheared edge under the punching condition described above. The obtained test piece was evaluated with respect to the fatigue strength σp for fracturing at $10^5$ cycles using a Shank type plane bending tester.

The steel sheet of steel sheet No. 10 corresponds to a comparative steel sheet since the steel sheet does not satisfy Formula (1) (refer to Table 2).

TABLE 1

| Steel sheet No. | C | Si | Mn | Al | P | S | Ti | Nb | N | B | V | Mo | Cr | |
|---|---|---|---|---|---|---|---|---|---|---|---|---|---|---|
| 1 | 0.027 | 0.60 | 1.26 | 0.02 | 0.008 | 0.003 | 0.05 | 0.01 | 0.003 | — | — | — | — | Comparative Example |
| 2 | 0.126 | 0.60 | 1.32 | 0.02 | 0.008 | 0.003 | 0.06 | 0.01 | 0.003 | — | — | — | — | Comparative Example |
| 3 | 0.081 | 1.51 | 2.52 | 0.02 | 0.008 | 0.003 | 0.13 | 0.02 | 0.003 | — | — | — | — | Comparative Example |
| 4 | 0.060 | 0.60 | 0.76 | 0.02 | 0.008 | 0.003 | 0.06 | 0.01 | 0.003 | — | — | — | — | Comparative Example |
| 5 | 0.061 | 0.60 | 3.10 | 0.02 | 0.008 | 0.003 | 0.05 | 0.01 | 0.003 | — | — | — | — | Comparative Example |
| 6 | 0.038 | 0.06 | 1.32 | 0.73 | 0.008 | 0.003 | 0.05 | 0.01 | 0.003 | — | — | — | — | Comparative Example |
| 7 | 0.062 | 0.16 | 1.96 | 0.02 | 0.021 | 0.003 | 0.09 | 0.04 | 0.003 | — | — | — | — | Comparative Example |
| 8 | 0.060 | 0.16 | 1.96 | 0.02 | 0.008 | 0.012 | 0.09 | 0.04 | 0.003 | — | — | — | — | Comparative Example |
| 9 | 0.061 | 0.02 | 1.30 | 0.02 | 0.008 | 0.003 | 0.03 | 0.01 | 0.003 | — | — | — | — | Comparative Example |
| 10 | 0.060 | 0.15 | 1.96 | 0.02 | 0.008 | 0.003 | 0.18 | 0.04 | 0.003 | — | — | — | — | Comparative Example |
| 11 | 0.061 | 0.16 | 1.96 | 0.02 | 0.008 | 0.003 | 0.21 | 0.01 | 0.003 | — | — | — | — | Comparative Example |
| 12 | 0.036 | 0.65 | 1.28 | 0.02 | 0.008 | 0.003 | 0.05 | 0 | 0.003 | — | — | — | — | Comparative Example |
| 13 | 0.071 | 0.15 | 1.92 | 0.02 | 0.008 | 0.003 | 0.05 | 0.13 | 0.003 | — | — | — | — | Comparative Example |
| 14 | 0.060 | 0.96 | 1.37 | 0.02 | 0.008 | 0.003 | 0.13 | 0.04 | 0.008 | — | — | — | — | Comparative Example |
| 15 | 0.081 | 1.37 | 2.51 | 0.03 | 0.008 | 0.003 | 0.15 | 0.01 | 0.003 | 0.0007 | — | — | — | Comparative Example |
| 16 | 0.045 | 0.06 | 0.81 | 0.03 | 0.008 | 0.003 | 0.05 | 0.01 | 0.003 | — | 0.05 | — | — | Comparative Example |
| 17 | 0.082 | 1.31 | 2.52 | 0.02 | 0.008 | 0.003 | 0.14 | 0.02 | 0.003 | 0.0008 | — | 0.18 | — | Comparative Example |
| 18 | 0.079 | 1.41 | 2.54 | 0.02 | 0.008 | 0.003 | 0.15 | 0.02 | 0.003 | 0.0008 | — | 0.09 | — | Comparative Example |
| 19 | 0.135 | 0.60 | 1.32 | 0.02 | 0.008 | 0.003 | 0.06 | 0.01 | 0.003 | — | — | — | 0.08 | Comparative Example |
| 20 | 0.036 | 0.02 | 1.37 | 0.31 | 0.008 | 0.003 | 0.05 | 0.01 | 0.003 | — | — | — | — | Present Invention |
| 21 | 0.060 | 0.95 | 1.38 | 0.03 | 0.008 | 0.003 | 0.13 | 0.04 | 0.003 | — | — | — | — | Present Invention |
| 22 | 0.060 | 0.15 | 1.97 | 0.03 | 0.008 | 0.003 | 0.10 | 0.04 | 0.003 | — | — | — | — | Present Invention |
| 23 | 0.046 | 0.71 | 1.23 | 0.03 | 0.008 | 0.003 | 0.05 | 0.01 | 0.003 | — | — | — | — | Present Invention |
| 24 | 0.081 | 0.02 | 1.01 | 0.03 | 0.008 | 0.003 | 0.15 | 0.01 | 0.003 | — | — | — | — | Present Invention |
| 25 | 0.080 | 0.02 | 1.50 | 0.03 | 0.008 | 0.003 | 0.15 | 0.01 | 0.003 | — | — | — | — | Present Invention |
| 26 | 0.080 | 0.01 | 2.02 | 0.03 | 0.008 | 0.003 | 0.15 | 0.01 | 0.003 | — | — | — | — | Present Invention |
| 27 | 0.062 | 0.02 | 1.52 | 0.03 | 0.008 | 0.003 | 0.15 | 0.01 | 0.003 | — | — | — | — | Present Invention |
| 28 | 0.062 | 0.02 | 1.51 | 0.03 | 0.008 | 0.003 | 0.15 | 0.03 | 0.003 | — | — | — | — | Present Invention |
| 29 | 0.100 | 0.01 | 1.51 | 0.03 | 0.008 | 0.003 | 0.15 | 0.01 | 0.003 | — | — | — | — | Present Invention |
| 30 | 0.080 | 0.01 | 1.52 | 0.03 | 0.008 | 0.003 | 0.11 | 0.01 | 0.003 | — | — | — | — | Present Invention |
| 31 | 0.082 | 0.02 | 1.52 | 0.03 | 0.008 | 0.003 | 0.13 | 0.01 | 0.003 | — | — | — | — | Present Invention |
| 32 | 0.081 | 0.31 | 1.53 | 0.03 | 0.008 | 0.003 | 0.15 | 0.01 | 0.003 | — | — | — | — | Present Invention |
| 33 | 0.081 | 0.01 | 2.53 | 0.03 | 0.008 | 0.003 | 0.15 | 0.01 | 0.003 | — | — | — | — | Present Invention |
| 34 | 0.081 | 0.01 | 1.53 | 0.03 | 0.008 | 0.003 | 0.15 | 0.04 | 0.003 | — | — | — | — | Present Invention |
| 35 | 0.061 | 0.01 | 2.52 | 0.03 | 0.008 | 0.003 | 0.15 | 0.01 | 0.003 | — | — | — | — | Present Invention |
| 36 | 0.061 | 1.15 | 2.50 | 0.03 | 0.008 | 0.003 | 0.14 | 0.02 | 0.003 | — | — | — | — | Present Invention |
| 37 | 0.062 | 1.19 | 2.51 | 0.03 | 0.008 | 0.003 | 0.17 | 0.01 | 0.003 | 0.0015 | — | — | — | Present Invention |
| 38 | 0.062 | 0.06 | 1.33 | 0.46 | 0.008 | 0.003 | 0.11 | 0.01 | 0.003 | — | — | — | — | Present Invention |
| 39 | 0.040 | 0.01 | 1.50 | 0.03 | 0.008 | 0.003 | 0.10 | 0.01 | 0.003 | — | — | — | — | Present Invention |
| 40 | 0.072 | 1.17 | 2.45 | 0.03 | 0.008 | 0.003 | 0.15 | 0.01 | 0.003 | — | 0.08 | — | — | Present Invention |
| 41 | 0.081 | 1.18 | 2.46 | 0.03 | 0.008 | 0.003 | 0.14 | 0.02 | 0.003 | — | — | 0.18 | — | Present Invention |
| 42 | 0.062 | 0.01 | 1.50 | 0.03 | 0.008 | 0.003 | 0.10 | 0.01 | 0.003 | — | 0.08 | — | 0.08 | Present Invention |
| 43 | 0.082 | 1.18 | 2.51 | 0.03 | 0.008 | 0.003 | 0.14 | 0.01 | 0.003 | 0.0013 | 0.09 | — | — | Present Invention |
| 44 | 0.075 | 1.09 | 2.51 | 0.03 | 0.008 | 0.003 | 0.16 | 0.01 | 0.003 | 0.0013 | — | 0.16 | — | Present Invention |
| 45 | 0.060 | 0.95 | 1.38 | 0.03 | 0.008 | 0.003 | 0.13 | 0.04 | 0.003 | — | — | — | 0.09 | Present Invention |

In Table 2, with regard to all of the test numbers, the yield stress, the tensile strength, the total elongation, the burring formability λ, the presence or absence of the separation development at the sheared edge, the fatigue strength σp at $10^5$ cycles of the sheared edge, and the ratio σp/TS of the fatigue strength at $10^5$ cycles to the tensile strength are indicated.

TABLE 2

| Test No. | Steel sheet No. | Final rolling temp. (° C.) in finish rolling | Total rolling reduction at last two stands (%) | Coiling temp. (° C.) | Formula (1) | Pole density | Aspect ratio of prior austenite grains | Density of precipitates of 20 nm or less (pieces/mm$^3$) | Yield strength (MPa) | Tensile strength (MPa) | Yield Ratio YR | Total elongation (%) | Burring formability λ (%) |
|---|---|---|---|---|---|---|---|---|---|---|---|---|---|
| 1 | 1 | 964 | 35.1 | 570 | 0.013 | 1.84 | 2.16 | 8.98E+09 | 482 | 519 | 0.93 | 32.0 | 151.0 |
| 2 | 2 | 965 | 36.2 | 570 | 0.109 | 1.96 | 3.29 | 8.47E+09 | 581 | 622 | 0.93 | 30.3 | 43.0 |
| 3 | 3 | 989 | 41.0 | 550 | 0.046 | 2.86 | 3.35 | 6.96E+10 | 859 | 991 | 0.87 | 16.2 | 67.0 |
| 4 | 4 | 968 | 34.4 | 570 | 0.044 | 2.06 | 1.78 | 7.78E+09 | 483 | 523 | 0.92 | 29.8 | 76.0 |
| 5 | 5 | 966 | 32.4 | 550 | 0.047 | 4.31 | 6.92 | 7.41E+09 | 952 | 1082 | 0.88 | 8.9 | 52.0 |
| 6 | 6 | 962 | 35.2 | 600 | 0.024 | 2.37 | 2.49 | 1.01E+09 | 415 | 563 | 0.74 | 29.1 | 112.0 |
| 7 | 7 | 983 | 34.1 | 570 | 0.034 | 2.46 | 2.76 | 1.86E+10 | 701 | 765 | 0.92 | 16.3 | 71.0 |
| 8 | 8 | 988 | 34.5 | 550 | 0.032 | 2.67 | 2.20 | 1.55E+10 | 689 | 761 | 0.91 | 15.9 | 79.2 |

TABLE 2-continued

| | | | | | | | | | | | | | |
|---|---|---|---|---|---|---|---|---|---|---|---|---|---|
| 9 | 9 | 964 | 31.7 | 550 | 0.052 | 1.35 | 1.20 | 8.14E+08 | 429 | 541 | 0.79 | 31.0 | 66.0 |
| 10 | 10 | 1034 | 43.1 | 580 | 0.010 | 4.67 | 3.90 | 2.40E+11 | 726 | 862 | 0.84 | 16.2 | 89.0 |
| 11 | 11 | 1026 | 41.4 | 600 | 0.007 | 4.98 | 6.59 | 2.83E+11 | 769 | 842 | 0.91 | 14.3 | 71.0 |
| 12 | 12 | 968 | 34.7 | 580 | 0.023 | 2.41 | 2.61 | 1.67E+10 | 427 | 575 | 0.74 | 25.5 | 124.0 |
| 13 | 13 | 1063 | 45.0 | 550 | 0.041 | 5.87 | 4.84 | 7.08E+09 | 756 | 839 | 0.90 | 19.7 | 61.0 |
| 14 | 14 | 1027 | 40.5 | 550 | 0.022 | 3.01 | 2.97 | 1.05E+10 | 739 | 808 | 0.91 | 19.6 | 96.0 |
| 15 | 15 | 1054 | 44.9 | 550 | 0.042 | 4.84 | 5.15 | 6.15E+10 | 890 | 1081 | 0.82 | 13.5 | 62.5 |
| 16 | 16 | 968 | 37.5 | 510 | 0.031 | 2.01 | 2.49 | 3.13E+09 | 499 | 571 | 0.87 | 28.2 | 127.0 |
| 17 | 17 | 1051 | 40.5 | 550 | 0.044 | 5.11 | 5.12 | 7.26E+10 | 938 | 1132 | 0.83 | 13.5 | 67.1 |
| 18 | 18 | 1041 | 41.2 | 550 | 0.039 | 4.89 | 4.78 | 8.16E+10 | 936 | 1110 | 0.84 | 14.2 | 67.1 |
| 19 | 19 | 976 | 37.3 | 570 | 0.118 | 1.84 | 3.15 | 9.16E+09 | 534 | 648 | 0.82 | 29.9 | 45.0 |
| 20 | 20 | 966 | 38.0 | 510 | 0.022 | 1.76 | 2.85 | 2.13E+09 | 580 | 624 | 0.93 | 27.0 | 132.0 |
| 21 | 20 | 899 | 40.5 | 510 | 0.022 | 5.21 | 5.48 | 1.64E+09 | 598 | 655 | 0.91 | 28.0 | 88.0 |
| 22 | 21 | 988 | 43.1 | 510 | 0.022 | 2.98 | 2.93 | 1.71E+11 | 747 | 800 | 0.93 | 21.0 | 92.0 |
| 23 | 22 | 984 | 42.1 | 630 | 0.030 | 1.98 | 2.71 | 3.19E+10 | 690 | 773 | 0.89 | 18.7 | 79.2 |
| 24 | 22 | 903 | 40.3 | 630 | 0.030 | 3.67 | 6.04 | 4.58E+10 | 747 | 817 | 0.91 | 19.0 | 63.0 |
| 25 | 23 | 967 | 32.5 | 480 | 0.032 | 2.42 | 1.73 | 5.57E+09 | 537 | 609 | 0.88 | 26.0 | 121.0 |
| 26 | 24 | 1027 | 42.8 | 530 | 0.042 | 3.48 | 2.06 | 8.31E+10 | 702 | 770 | 0.91 | 16.2 | 67.5 |
| 27 | 25 | 1011 | 40.7 | 530 | 0.041 | 3.67 | 2.01 | 6.92E+10 | 695 | 795 | 0.87 | 17.8 | 78.0 |
| 28 | 26 | 1028 | 40.1 | 530 | 0.041 | 4.01 | 2.56 | 8.99E+10 | 742 | 844 | 0.88 | 15.5 | 59.5 |
| 29 | 27 | 1021 | 40.8 | 530 | 0.022 | 3.32 | 2.27 | 7.58E+10 | 690 | 788 | 0.88 | 19.0 | 83.0 |
| 30 | 28 | 1022 | 43.6 | 530 | 0.020 | 3.78 | 3.47 | 5.04E+10 | 680 | 797 | 0.85 | 18.8 | 70.3 |
| 31 | 29 | 1028 | 41.6 | 530 | 0.061 | 3.14 | 3.36 | 6.11E+10 | 721 | 806 | 0.89 | 17.4 | 78.1 |
| 32 | 30 | 981 | 40.7 | 530 | 0.051 | 2.79 | 2.54 | 6.64E+09 | 682 | 743 | 0.92 | 15.1 | 62.5 |
| 33 | 31 | 1024 | 42.4 | 530 | 0.048 | 2.97 | 3.79 | 5.31E+10 | 691 | 774 | 0.89 | 16.5 | 66.8 |
| 34 | 32 | 1027 | 42.6 | 530 | 0.042 | 2.91 | 3.30 | 8.55E+10 | 736 | 825 | 0.89 | 18.4 | 61.0 |
| 35 | 33 | 1022 | 40.6 | 530 | 0.042 | 3.89 | 1.65 | 6.60E+10 | 879 | 944 | 0.93 | 13.9 | 50.6 |
| 36 | 34 | 1024 | 41.9 | 530 | 0.038 | 4.11 | 3.46 | 6.15E+10 | 801 | 874 | 0.92 | 16.2 | 47.0 |
| 37 | 35 | 1028 | 42.7 | 530 | 0.022 | 4.89 | 1.42 | 7.17E+10 | 860 | 938 | 0.92 | 16.6 | 63.4 |
| 38 | 35 | 962 | 42.6 | 530 | 0.022 | 5.97 | 3.48 | 1.06E+11 | 855 | 955 | 0.90 | 15.3 | 49.0 |
| 39 | 36 | 1055 | 43.4 | 550 | 0.022 | 4.38 | 2.71 | 9.70E+10 | 860 | 967 | 0.89 | 15.1 | 68.0 |
| 40 | 36 | 939 | 40.6 | 550 | 0.022 | 6.7S | 3.63 | 3.51E+10 | 864 | 991 | 0.87 | 18.5 | 51.0 |
| 41 | 37 | 1030 | 43.2 | 520 | 0.018 | 5.64 | 2.04 | 4.76E+09 | 887 | 1095 | 0.81 | 13.4 | 61.8 |
| 42 | 37 | 935 | 45.3 | 520 | 0.018 | 7.03 | 5.93 | 5.59E+09 | 874 | 1088 | 0.80 | 14.2 | 43.0 |
| 43 | 38 | 989 | 41.1 | 600 | 0.033 | 1.68 | 2.27 | 3.93E+10 | 672 | 731 | 0.92 | 21.8 | 121.0 |
| 44 | 38 | 983 | 40.0 | 400 | 0.033 | 2.45 | 2.48 | 4.25E+08 | 620 | 791 | 0.78 | 18.5 | 81.0 |
| 45 | 39 | 985 | 40.2 | 600 | 0.014 | 1.39 | 2.48 | 3.29E+10 | 734 | 781 | 0.94 | 20.8 | 115.0 |
| 46 | 39 | 939 | 43.2 | 530 | 0.014 | 3.48 | 7.45 | 6.79E+09 | 685 | 779 | 0.88 | 16.0 | 106.0 |
| 47 | 20 | 971 | 26.3 | 510 | 0.022 | 2.84 | 5.35 | 1.55E+09 | 544 | 638 | 0.85 | 29.2 | 109.0 |
| 48 | 30 | 984 | 38.1 | 530 | 0.051 | 4.79 | 6.16 | 8.54E+09 | 658 | 739 | 0.89 | 16.3 | 54.6 |
| 49 | 40 | 1041 | 40.8 | 530 | 0.014 | 3.85 | 3.73 | 5.20E+10 | 899 | 1054 | 0.85 | 14.3 | 64.1 |
| 50 | 41 | 1030 | 40.2 | 530 | 0.042 | 4.45 | 5.25 | 3.10E+11 | 867 | 1071 | 0.81 | 13.4 | 68.1 |
| 51 | 20 | 963 | 40.4 | 660 | 0.022 | 2.01 | 2.96 | 8.62E+08 | 446 | 563 | 0.79 | 31.2 | 132.0 |
| 52 | 31 | 986 | 40.5 | 600 | 0.014 | 1.84 | 2.78 | 4.68E+10 | 745 | 821 | 0.91 | 21.6 | 121.0 |
| 53 | 43 | 1024 | 40.5 | 600 | 0.039 | 3.99 | 3.59 | 6.30E+10 | 889 | 1093 | 0.81 | 14.5 | 52.0 |
| 54 | 44 | 1015 | 42.1 | 600 | 0.027 | 4.67 | 4.55 | 5.91E+09 | 954 | 1135 | 0.84 | 13.9 | 63.0 |
| 55 | 45 | 998 | 43.4 | 530 | 0.017 | 3.41 | 2.98 | 5.26E+10 | 729 | 815 | 0.89 | 20.1 | 85.3 |
| 56 | 42 | 985 | 42.8 | 600 | 0.036 | 3.75 | 4.65 | 7.52E+09 | 734 | 781 | 0.94 | 22.1 | 115.0 |

| Test No. | Steel sheet No. | Presence of separation at sheared edge | Fatigue strength σp at $10^5$ cycles of sheared edge (MPa) | Ratio σp/TS of fatigue strength at $10^5$ cycles to tensile strength | Manufacturing method | Ingredients | Note |
|---|---|---|---|---|---|---|---|
| 1 | 1 | Present | 234 | 0.45 | Inv. | Comp. | Comp. Steel |
| 2 | 2 | Absent | 178 | 0.29 | Inv. | Comp. | Comp. Steel |
| 3 | 3 | Absent | 303 | 0.31 | Inv. | Comp. | Comp. Steel |
| 4 | 4 | Present | 222 | 0.42 | Inv. | Comp. | Comp. Steel |
| 5 | 5 | Absent | 313 | 0.29 | Inv. | Comp. | Comp. Steel |
| 6 | 6 | Present | 231 | 0.41 | Inv. | Comp. | Comp. Steel |
| 7 | 7 | Absent | 208 | 0.27 | Inv. | Comp. | Comp. Steel |
| 8 | 8 | Absent | 241 | 0.32 | Inv. | Comp. | Comp. Steel |
| 9 | 9 | Present | 238 | 0.44 | Inv. | Comp. | Comp. Steel |
| 10 | 10 | Absent | 234 | 0.27 | Inv. | Comp. | Comp. Steel |
| 11 | 11 | Absent | 227 | 0.27 | Inv. | Comp. | Comp. Steel |
| 12 | 12 | Present | 298 | 0.52 | Inv. | Comp. | Comp. Steel |
| 13 | 13 | Absent | 237 | 0.28 | Inv. | Comp. | Comp. Steel |
| 14 | 14 | Absent | 223 | 0.28 | Inv. | Comp. | Comp. Steel |
| 15 | 15 | Absent | 315 | 0.29 | Inv. | Comp. | Comp. Steel |
| 16 | 16 | Absent | 165 | 0.29 | Inv. | Comp. | Comp. Steel |
| 17 | 17 | Absent | 277 | 0.25 | Inv. | Comp. | Comp. Steel |
| 18 | 18 | Absent | 350 | 0.32 | Inv. | Comp. | Comp. Steel |
| 19 | 19 | Absent | 201 | 0.31 | Inv. | Comp. | Comp. Steel |
| 20 | 20 | Present | 310 | 0.50 | Inv. | Inv. | Inv. Steel |
| 21 | 20 | Absent | 170 | 0.26 | Comp. | Inv. | Comp. Steel |
| 22 | 21 | Present | 404 | 0.51 | Inv. | Inv. | Inv. Steel |

TABLE 2-continued

| | | | | | | | |
|---|---|---|---|---|---|---|---|
| 23 | 22 | Present | 391 | 0.51 | Inv. | Inv. | Inv. Steel |
| 24 | 22 | Absent | 239 | 0.29 | Comp. | Inv. | Comp. Steel |
| 25 | 23 | Present | 257 | 0.42 | Inv. | Inv. | Inv. Steel |
| 26 | 24 | Present | 360 | 0.47 | Inv. | Inv. | Inv. Steel |
| 27 | 25 | Present | 344 | 0.43 | Inv. | Inv. | Inv. Steel |
| 28 | 26 | Present | 424 | 0.50 | Inv. | Inv. | Inv. Steel |
| 29 | 27 | Present | 331 | 0.42 | Inv. | Inv. | Inv. Steel |
| 30 | 28 | Present | 417 | 0.52 | Inv. | Inv. | Inv. Steel |
| 31 | 29 | Present | 372 | 0.46 | Inv. | Inv. | Inv. Steel |
| 32 | 30 | Present | 332 | 0.45 | Inv. | Inv. | Inv. Steel |
| 33 | 31 | Present | 384 | 0.50 | Inv. | Inv. | Inv. Steel |
| 34 | 32 | Present | 409 | 0.50 | Inv. | Inv. | Inv. Steel |
| 35 | 33 | Present | 490 | 0.52 | Inv. | Inv. | Inv. Steel |
| 36 | 34 | Present | 390 | 0.45 | Inv. | Inv. | Inv. Steel |
| 37 | 35 | Present | 398 | 0.42 | Inv. | Inv. | Inv. Steel |
| 38 | 35 | Absent | 273 | 0.29 | Comp. | Inv. | Comp. Steel |
| 39 | 36 | Present | 366 | 0.38 | Inv. | Inv. | Inv. Steel |
| 40 | 36 | Absent | 267 | 0.27 | Comp. | Inv. | Comp. Steel |
| 41 | 37 | Present | 423 | 0.39 | Inv. | Inv. | Inv. Steel |
| 42 | 37 | Absent | 312 | 0.29 | Comp. | Inv. | Comp. Steel |
| 43 | 38 | Present | 382 | 0.52 | Inv. | Inv. | Inv. Steel |
| 44 | 38 | Present | 352 | 0.44 | Comp. | Inv. | Comp. Steel |
| 45 | 39 | Present | 408 | 0.52 | Inv. | Inv. | Inv. Steel |
| 46 | 39 | Absent | 211 | 0.27 | Comp. | Inv. | Comp. Steel |
| 47 | 20 | Absent | 186 | 0.29 | Comp. | Inv. | Comp. Steel |
| 48 | 30 | Absent | 244 | 0.33 | Comp. | Inv. | Comp. Steel |
| 49 | 40 | Present | 437 | 0.42 | Inv. | Inv. | Inv. Steel |
| 50 | 41 | Present | 411 | 0.38 | Inv. | Inv. | Inv. Steel |
| 51 | 20 | Present | 265 | 0.47 | Comp. | Inv. | Comp. Steel |
| 52 | 31 | Present | 377 | 0.46 | Inv. | Inv. | Inv. Steel |
| 53 | 43 | Present | 486 | 0.45 | Inv. | Inv. | Inv. Steel |
| 54 | 44 | Present | 547 | 0.48 | Inv. | Inv. | Inv. Steel |
| 55 | 45 | Present | 341 | 0.42 | Inv. | Inv. | Inv. Steel |
| 56 | 42 | Present | 316 | 0.41 | Inv. | Inv. | Inv. Steel |

Inv.: Invention;
Comp.: Comparative.

Regarding Test Nos. 1, 4, 6, 9, 12, and 16, the ingredients composition of the steel sheet fell outside the scope of the invention, and as a result, the steel sheet had a tensile strength of 590 MPa or less. Regarding Test Nos. 2 and 10, the balance between Ti, Nb, and C indicated by Formula (1) fell outside the definition of the ingredients according to the invention, and as a result, separation developed at the sheared edge. Regarding Test No. 3, an excess amount of Si was contained, and as a result, chemical conversion coating treatability was deteriorated, and separation development was observed although the strength and the formability were not deteriorated. Regarding Test Nos. 7 and 8, segregation of P and S was observed, and development of separation initiated from the inclusion was observed at the sheared edge. Regarding Test No. 2, an excess amount of C was contained, and as a result, separation caused by a pearlite banded structure was observed, and a significant decrease in the burring formability λ was confirmed. Regarding the steel sheets containing B, under the appropriate manufacturing conditions according to the invention, a steel sheet having a strength of 1080 MPa or more was produced, and separation was suppressed. Regarding the tests containing V, Mo, and/or Cr, due to the combined effect with Ti and Nb, a high tensile strength was obtained without impairing the elongation and the burring formability. Failure to include the essential elements according to the invention in the respectively specified amounts resulted in separation development also in samples in which one or more of V, Mo, Cr, and/or B were contained, as in Test Nos. 15, 16, 17, 18, and 19.

Figure 14:
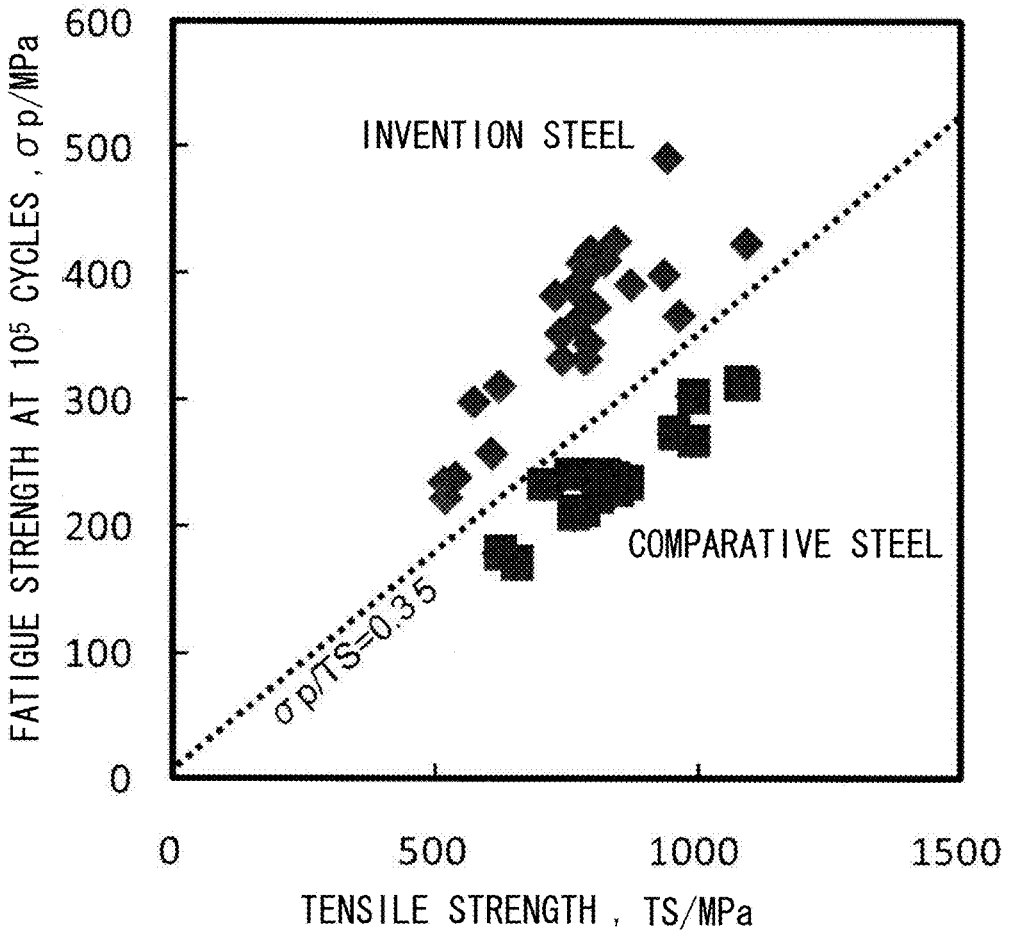
FIG. 14 shows an examination result of an effect of the invention based on a relationship between a fatigue strength σp at $10^5$ cycles and a tensile strength TS, in a steel according to the invention which satisfied all of the characteristics of ingredients and metal microstructure and in which separation was suppressed and a comparative steel which did not satisfy all of the characteristics of ingredients and metal microstructure and in which separation developed.

From these results, it was found that effects in terms of suppressing the separation at the sheared edge based on the characteristics of the microstructure of the metal are not exerted when the ingredients composition fell outside the range specified in the invention. Therefore, it was confirmed that the range of ingredients according to the invention is appropriate to exert a separation suppressing effect in relation to the pole density of {112}(110) at a position of ¼ plate thickness and the aspect ratio of prior austenite grains. With respect to various steel sheets having compositions within the appropriate ingredient ranges, the test results of hot-rolled steel sheets which had varied pole densities of {112}(110) at a position of ¼ plate thickness and varied aspect ratios of prior austenite grains and which were manufactured under the conditions within or outside the scope of the method of manufacturing a hot-rolled steel sheet according to the invention, are indicated in Test Nos. 15 to 56. When the finish rolling temperature and the total rolling reduction at two stands from the last stand did not both fall within their respective appropriate ranges, separation at the sheared edge was observed due to non-fulfillment of either one of a pole density of {112}(110) at a position of ¼ plate thickness of 5.7 or less or an aspect ratio of prior austenite grains of 5.3 or less. When the coiling temperature fell outside the range according to the invention, yield ratio separation did not develop. However, such steel sheets were inappropriate as the hot-rolled steel sheet according to the invention since the density of the precipitates was $10^9$ pieces/$mm^3$ or less, and YR fell below 0.80. These results indicate that a pole density of {112}(110) at a position of ¼ plate thickness and an aspect ratio of prior austenite grains both within their respective appropriate ranges could be achieved and separation at the sheared edge was suppressed by using a steel sheet containing the ingredients within the ranges specified by the invention and adopting the appropriate manufacturing conditions. The relationship between the fatigue strength σp at $10^5$ cycles and tensile strength TS of the sheared edge is shown in FIG. 14. In any of the steels according to the invention, the fatigue strength σp at $10^5$ cycles of the sheared edge was no less than 0.35 times the tensile strength TS. On the other hand, in the comparative steels in which separation developed, the fatigue strength σp at $10^5$ cycles of the sheared edge was less than 0.35 times the tensile strength TS.

Conventionally, it has been explained that, in a precipitation strengthened steel sheet containing Ti, separation develops due to a decrease in toughness associated with the acceleration of precipitation. However, in the invention, it was found that, by adjusting the contents of C, Ti, and Nb to their respective appropriate ranges, the microstructure of the metal to satisfy 0.106≥(C %-Ti %*12/48-Nb %*12/93)≥0.012, the pole density of {112}(110) at a position of ¼ plate thickness to 5.7 or less, and an aspect ratio of prior austenite grains to 5.3 or less, suppression of the separation at the sheared edge, which has been difficult to solve until now, can be achieved. As a result, a hot-rolled steel sheet having excellent fatigue strength σp at $10^5$ cycles of the sheared edge can be developed.

The invention claimed is:

1. A hot-rolled steel sheet comprising in terms of % by mass, 0.030% to 0.120% of C,
1.20% or less of Si,
1.00% to 3.00% of Mn,
0.01% to 0.70% of Al,
more than 0.10% to 0.20% of Ti,
0.01% to 0.10% of Nb,
0.020% or less of P,
0.010% or less of S,
0.005% or less of N, and
a balance comprising Fe and impurities, wherein 0.106≥(C %-Ti %*12/48-Nb %*12/93)≥0.012 is satisfied; a pole density of {112}(110) at a position of ¼ plate thickness is 5.7 or less; an aspect ratio (long axis/short axis) of prior austenite grains is 5.3 or less; a density of (Ti, Nb)C precipitates having a size of 20 nm or less is $10^9$ pieces/$mm^3$ to $10^{12}$ pieces/$mm^3$; a yield ratio YR, which is the ratio of a yield stress to a tensile strength, is 0.80 or more; and a tensile strength is 590 MPa or more.

2. The hot-rolled steel sheet according to claim 1, further comprising, in terms of % by mass, one or more of 0.0005% to 0.0015% of B,
0.09% or less of Cr,
0.01% to 0.10% of V, or
0.01% to 0.2% of Mo, wherein 0.106≥(C %-Ti %*12/48-Nb %*12/93-V %*12/51)≥0.012 is satisfied in a case where the hot-rolled steel sheet contains V.

3. A method of manufacturing the hot-rolled steel sheet according to claim 1, the method comprising:

heating a steel to 1250° C. or higher, the steel comprising, in terms of % by mass, 0.030% to 0.120% of C,
1.20% or less of Si,
1.00% to 3.00% of Mn,
0.01% to 0.70% of Al,
more than 0.10% to 0.20% of Ti,
0.01% to 0.10% of Nb,
0.020% or less of P,
0.010% or less of 5,
0.005% or less of N, and
a balance comprising Fe and impurities, wherein 0.106≥(C %-Ti %*12/48-Nb %*12/93)≥0.012 is satisfied;

hot rolling the heated steel at a final rolling temperature of 980° C. or higher in finish rolling with a total of rolling reductions at two stands from a last stand of 40% or more when a Ti content is in a range of 0.10%<Ti≤0.20%; and coiling the hot rolled steel at 450° C. to 650° C.

4. The method of manufacturing a hot-rolled steel sheet according to claim 3, wherein the steel further comprises, in terms of % by mass, one or more of 0.0005% to 0.0015% of B,
0.09% or less of Cr,
0.01% to 0.10% of V, or
0.01% to 0.2% of Mo, wherein 0.106≥(C %-Ti %*12/48-Nb %*12/93-V %*12/51)≥0.012 is satisfied in a case where the steel contains V.

* * * * *